US006609707B1

(12) United States Patent
Yano

(10) Patent No.: US 6,609,707 B1
(45) Date of Patent: Aug. 26, 2003

(54) SHEET FEEDING APPARATUS, AND IMAGE FORMING APPARATUS AND IMAGE READING APPARATUS PROVIDED WITH SHEET FEEDING APPARATUS

(75) Inventor: Takashi Yano, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,902

(22) Filed: Sep. 27, 2000

(30) Foreign Application Priority Data

Oct. 4, 1999 (JP) ..... 11-282600
Jul. 14, 2000 (JP) ..... 2000-214390

(51) Int. Cl.[7] ..... B65H 5/00

(52) U.S. Cl. ..... 271/10.05; 271/10.13; 271/122; 271/127; 271/160

(58) Field of Search ..... 271/10.05, 10.09, 271/10.13, 4.08, 4.1, 10.11, 122, 126, 127, 160

(56) References Cited

U.S. PATENT DOCUMENTS 5,016,866 A * 5/1991 Takahashi ..... 271/122
5,582,399 A * 12/1996 Sugiura ..... 271/10.11
5,725,208 A * 3/1998 Miyauchi ..... 271/127
6,045,220 A * 4/2000 Kiyohara et al. ..... 271/126
6,059,281 A * 5/2000 Nakamura et al. ..... 271/127
6,260,840 B1 * 7/2001 Suga et al. ..... 271/10.13

FOREIGN PATENT DOCUMENTS

JP 0082746 * 7/1981 ..... 271/126
JP 0196422 * 8/1988 ..... 271/126

* cited by examiner

*Primary Examiner*—David H. Bollinger
(74) *Attorney, Agent, or Firm*—Fitzpatrick, Cella, Harper & Scinto

(57) ABSTRACT

The manual sheet feeding apparatus according to the conventional art employing a retard separating system requires a pick-up roller for feeding sheets one by one from the bundle of sheets, a mechanism for detaching the pick-up roller, a shutter, and a shutter solenoid for controlling the shutter. Consequently, these requirements cause need of a large space, a complex system, and high cost. In order to improve the above issue, they are provided, a sheet feeding apparatus for use in image forming apparatuses and image reading apparatuses which have the following features. A sheet supported by a displaceable sheet supporting unit of the sheet feeding apparatus is fed by a feeding rotation body. A separating rotation body is pressed against the feeding rotation body and is operated to force an extra sheet in a reverse direction.

5 Claims, 15 Drawing Sheets

| ANGLE OF INCIDENCE | 25 | 30 | 35 | 40 | 45 | 50 | 55 | 60 |
|---|---|---|---|---|---|---|---|---|
| STABILITY OF SHEET FEEDING | ◎ | ◎ | ○ | ○ | ○ | △ | △ | × |

INITIAL POSITION

POSITION OF MIDDLE PLATE PRESSURE COMPLETION ($\theta$1 ROTATION)

POSITION OF SHEET PRE-FEEDING START ($\theta$2 ROTATION)

POSITION OF SHEET PRE-FEEDING COMPLETION ($\theta$3 ROTATION)

POSITION OF MIDDLE PLATE PRESSURE RELEASING COMPLETION ($\theta$4 ROTATION)

POSITION OF SHEET REFEEDING START ($\theta$5 ROTATION)

POSITION OF SHEET REFEEDING COMPLETION (INITIAL POSITION) (COMPLETION OF 1 ROTATION)

INITIAL CONDITION
(PULL CLUTCH IS ON)

COMPLETION OF MIDDLE
PLATE (70) PRESSURIZATION

START OF SHEET
PRE-FEEDING

COMPLETION OF SHEET
PRE-FEEDING

COMPLETION OF MIDDLE PANEL (70) RELEASING

START OF SHEET REFEEDING

COMPLETION OF SHEET REFEEEDING

COMPLETION OF REGISTRATION LOOP FORMING

SHEET FEEDING APPARATUS, AND IMAGE FORMING APPARATUS AND IMAGE READING APPARATUS PROVIDED WITH SHEET FEEDING APPARATUS

BACKGROUND OF THE INVENTION

1. Field of the Invention

The present invention relates to feeding apparatuses and, more particularly, to a feeding apparatus for use in image forming apparatuses and image reading apparatuses such as a copying machine and a printer or the like.

2. Related Background Art

FIG. 13 is a schematic sectional view of a manual sheet feeding apparatus capable of continuous sheet feeding using a retard separation system according to a conventional art.

Referring to FIG. 13, reference numeral 102 denotes a pick-up roller driven and controlled by a conveyor clutch 108 for rotation and suspension of rotation, so as to feed a sheet S carried on a sheet feeding tray 101 one by one. After the sheet S is transported to a separation position between a separating roller 104 and a sheet feeding roller 103, a pick-up solenoid 106 causes the pick-up roller 102 to be detached from the sheet S.

This detachment is necessary to ensure that, in the case where a plurality of sheets are transported to a separation position at the time of a pick-up operation by the pick-up roller 102 (hereinafter, such a situation will be referred to as double feeding), the double feeding can be certainly prevented by not hindering any reverse force of the sheet which is double fed at the time of separation by the separating roller 104.

Moreover, in a non-active state of the main system, the pick-up roller 102 is also caused by the pick-up solenoid 106 to be detached from the sheet to ensure that the pick-up roller 102 does not hinder a setting operation performed by a user.

Additionally, a shutter 110 activated only when a sheet feeding apparatus is in a non-active state is provided to ensure that a user's inappropriate operation performed in setting a bundle of sheets does not cause the bundle of sheets to advance to the separation position and to provide the user with a feedback pressure so that the inappropriate setting operation does not cause a malfunction of the pick-up operation. The shutter solenoid 107 causes the shutter 110 to operate properly.

As described above, the manual sheet feeding apparatus according to the conventional art that employs the retard separating system requires the pickup roller 102 for feeding the sheet S one by one from the bundle of sheets. Further, a mechanism for detaching the pick-up roller 102 from the sheet, implemented by the solenoid 106, is necessary not to hinder any setting operation.

The shutter 110, which prevents the user's inappropriate operation, and the shutter solenoid 107 for controlling the shutter 110 are necessary.

Consequently, the requirement for space for housing the system may grow significantly, the construction may become complex and the cost of manufacturing may become relatively expensive.

Another disadvantage is that, in the construction described above, the driving and control of the pick-up roller 102 for rotation and suspension of rotation, as well as the control of the pick-up roller 102 for elevation and lowering require the conveyor clutch 108 and the shutter solenoid 106. Therefore, the likelihood that an error is produced in actuating the conveyor clutch 108 and the shutter solenoid is relatively great. As a result, the operation of the sheet feeding apparatus may be improperly timed, thereby causing double feeding or paper jam.

For example, the detachment of the pick-up roller 102 should be properly timed to occur when the leading edge of the sheet S reaches a nip between the sheet feeding roller 103 and the separating roller 104. Otherwise, delayed feed paper jam occurs. The detachment of the pick-up roller 102 should also occur before the leading edge of the sheet reaches a feed roller pair 105 provided downstream. Otherwise, the pick-up roller 102 loses the chance to force the sheet backward, thus causing double feeding. Thus, double feeding or paper jam is caused.

Moreover, timing requirement for the control of the conveyor clutch 108 and the solenoid 106 is so great as to make the control procedure extremely complex.

SUMMARY OF THE INVENTION

The present invention has been developed in view of the disadvantages described above and has an object of providing a sheet feeding apparatus and an image forming apparatus provided with the same, in which the cost and size are reduced by simplifying the construction, and in which proper timing is maintained and the stable sheet feeding and separation are performed. A typical components of the apparatus include displaceable sheet supporting means for supporting sheets; a feeding rotation body for feeding the sheet forward by contacting the sheet supported by the displaceable sheet supporting means and rotating in a direction of transportation of the sheet; and a separating roller pressed against the feeding rotation body and rotated in a direction to force the sheet fed by the feeding rotation body backward so as to separate the sheet. The sheet supporting means, the feeding rotation body and the separating rotation body are disposed such that an angle $\theta$ satisfies a condition $15\times(\pi/180)$ rad $(=15°)\leqq\theta\leqq50\times(\pi/\pi180)$ rad $(=50°)$, where $\theta$ denotes an angle between a line tangent to the feeding rotation body when the sheet supporting means is displaced to cause the topmost sheet supported by the sheet supporting means comes into contact with the feeding rotation body, and a nip line of a nip where the feeding rotation body and the separating rotation body are pressed against each other.

DESCRIPTION OF THE PREFERRED EMBODIMENTS

A description will now be given of a sheet feeding apparatus according to an embodiment of the present invention and its application to an image forming apparatus.

First, a general description of the image forming apparatus provided with the sheet feeding apparatus of the invention will be given.

Figure 1:
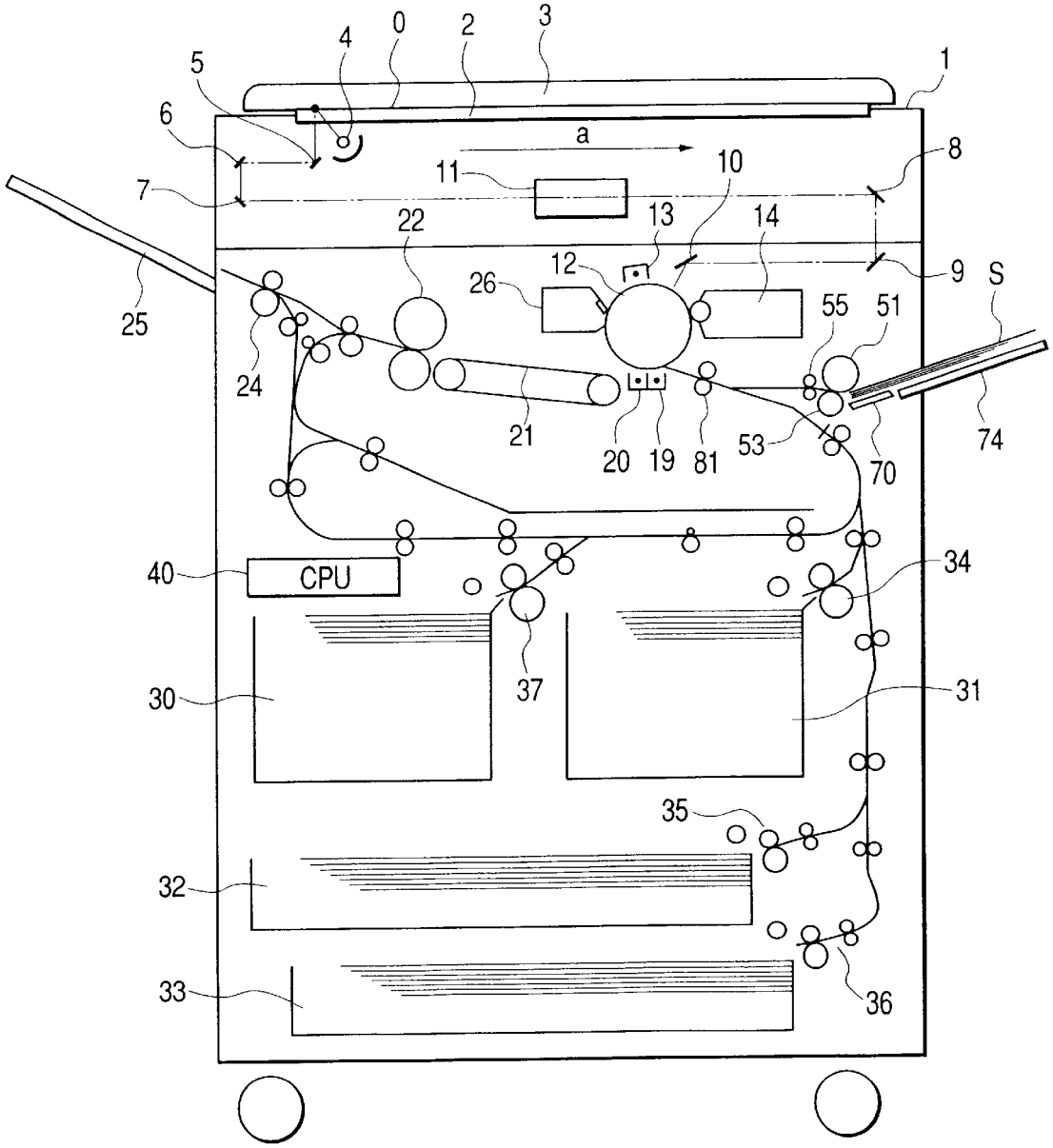
FIG. 1 is a schematic sectional view showing a copying machine provided with a sheet feeding apparatus according to an embodiment of the present invention.

FIG. 1 is a schematic sectional view of a copying machine as an example of the image forming apparatus. Referring to FIG. 1, reference numeral 1 denotes a copying machine main body. An original table implemented by a transparent glass plate secured to the top of the copying machine main body 1. Reference numeral 3 denotes an original pressuring plate for pressing an original O by making an image surface in the downward direction at a predetermined position on the original table 2.

Below the original table 2 is an optical system comprising a lamp 4 illuminating the original O, reflecting mirrors 5, 6, 7, 8, 9 and 10 for leading a photo-image of the illuminated original O to a photosensitive drum 12 and an image forming lens 11. The lamp 4 and the reflecting mirrors 5, 6 and 7 are moved in a direction indicated by the arrow a at a predetermined speed so as to scan the original O.

A sheet feeding unit is provided with cassette feeding units 34, 35, 36 and 37 for feeding sheets carried in sheet cassettes 30, 31, 32 and 33 to an image formation section, and sheet feeding units 51, 53, 55 and 70 (hereinafter, referred to as multi-feeding units) according to the invention for feeding sheets of various materials and sizes successively from a sheet feeding tray 74 to the image formation section.

The image formation section comprises: a photosensitive drum 12; a charging device 13 for uniformly charging on the photosensitive drum 12; a developer 14 for developing a latent image formed on the photosensitive drum 12 by a light emitted by the optical system so as to form a toner image to be transferred to the sheet S; a transferring charger 19 for transferring the toner image developed on the photosensitive drum 12 to the sheet S; a separating charger 20 for separating the sheet S to which the toner image transferred from the photosensitive drum 12; and a cleaner 26 for removing the toner that remains on the photosensitive drum 12 after the toner image is transferred.

Downstream from the image formation section is provided a transporting portion 21 for transporting the sheet S to which the toner image is transferred, and a fixing device 22 for permanently fixing the image on the sheet S transported by the transporting portion 21. There is further provided an ejecting roller 24 for ejecting the sheet S having the image thereon fixed by the fixing device 22 from the copying machine main body 1. Exterior to the copying machine main body 1, there is provided an ejection tray 25 for receiving the sheet S ejected by the ejecting roller 24.

A detailed description will now be given of the multi-feeding units. The multi-feeding units embody the sheet feeding apparatus provided in the image forming apparatus.

Figure 2:
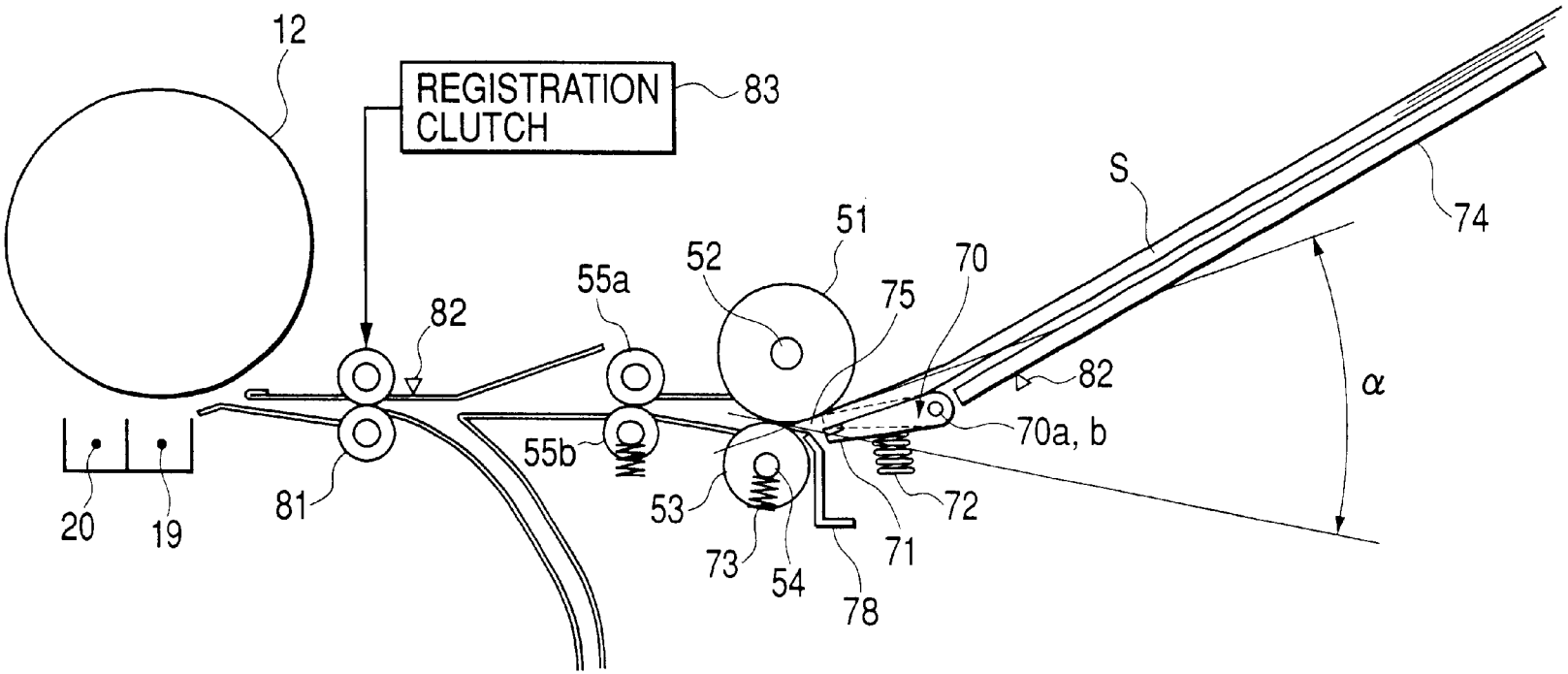
FIG. 2 is a sectional view showing an important portion of the sheet feeding apparatus according to the embodiment of the present invention.
Figure 3:
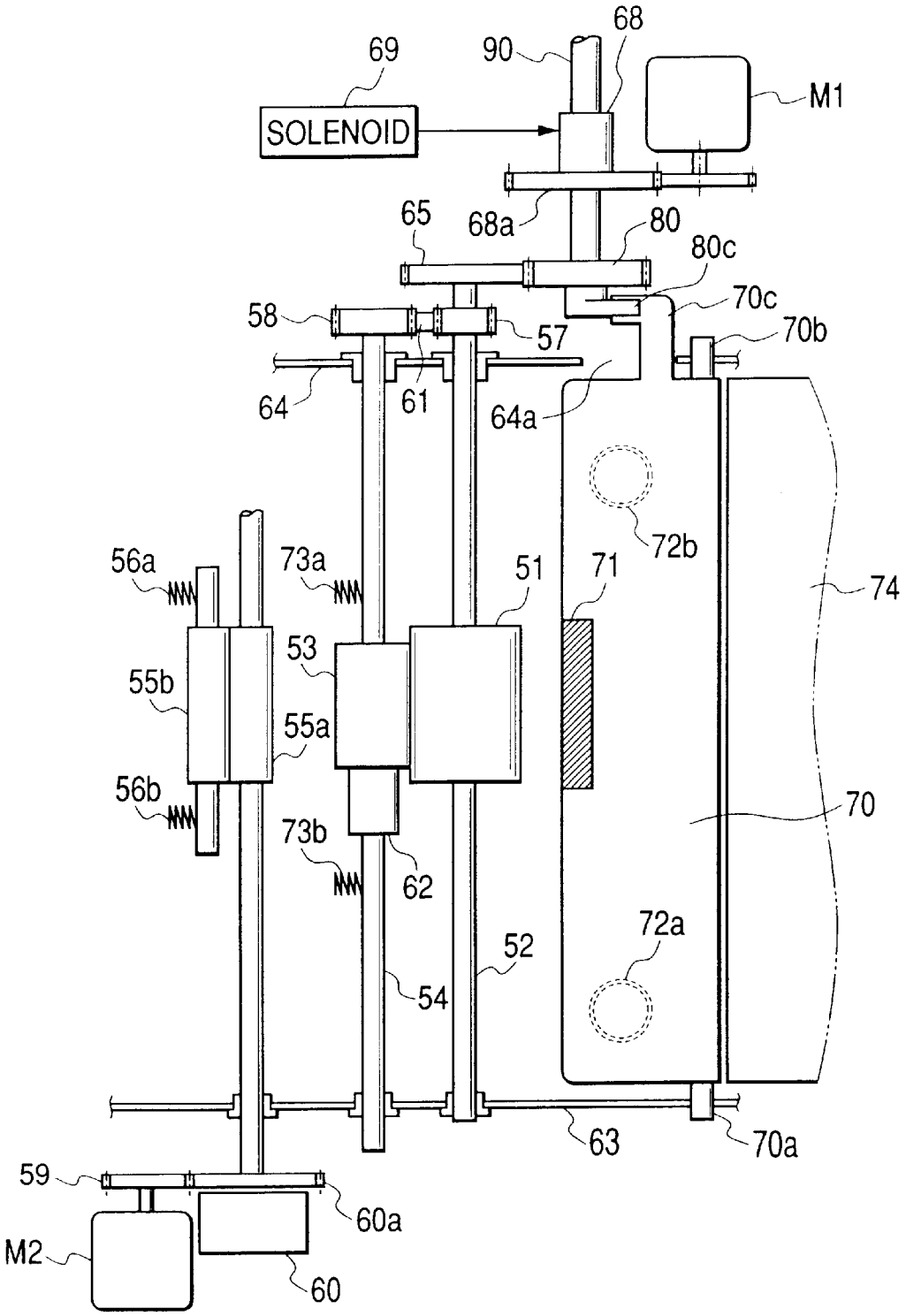
FIG. 3 is an expansion plan of a driving mechanism of the sheet feeding apparatus according to the embodiment of the present invention.

FIG. 2 is a sectional view of the multi-feeding units and the drum unit. FIG. 3 is an expansion plan (plane view) showing a driving mechanism of the multi-feeding units. The copying machine main body 1 is provided with a multi-feeding tray 74 for carrying a bundle of sheet S. The multi-feeding tray 74 is provided with a sheet detecting sensor 82 implemented by a photointerpreter or the like for detecting the sheet S on the tray 74.

A middle plate 70 that embodies the sheet supporting means is provided in a front side plate 63 and a rear side plate 64 of the copying machine main body 1 so as to be pivot-supported by sections 70*a* and 70*b*. Referring to FIG. 2, urging springs 72*a* and 72*b* (generically indicated as 72) that embody pressing and separating means provides a clockwise momentum to the middle plate 70, urging the middle plate in a direction of pressing a sheet feeding roller 51.

A pressing and separating unit described later either presses the sheet against the sheet feeding roller 51 as a feeding rotation body (as indicated by the broken line of FIG. 2) or releases that pressure (as indicated by the solid line of FIG. 2).

A felt 71 for preventing double feeding of the sheet S and canceling shock occurring when the middle plate 70 is pressed against the sheet feeding roller 51 is attached at the leading edge of the middle plate 70 contacting the sheet feeding roller 51.

If the pressure on the middle plate 70 against the sheet feeding roller 51 is too great, fastness to double feeding suffers. If the pressure is too small, an external force may come into play, thereby causing improper pressuring.

Experiments with sheet feeding according to the embodiment led to the selection of a spring pressure of the urging springs 72*a* and 72*b* which varies within a range between 1.5 N and 3.0 N (≅150 gf to 300 gf), the number of sheets carried and differences in sizes of the carried sheet being considered.

The sheet feeding roller 51 is fixed to a sheet feeding roller shaft 52. The sheet feeding roller shaft 52 is rotatably secured to the front side plate 63 and the rear side plate 64.

At a rear end of the sheet feeding roller shaft 52 is provided a sheet feeding driving gear 65 and a pulley 57 that embodies connecting means. A counterpart pulley 58 connected to the pulley 57 of the sheet feeding roller 52 by a driving belt 61 is secured to a separating roller shaft 54 which is a separating rotation body, so that the separating roller shaft 54 is rotated in the same direction as the sheet feeding roller shaft 52 and in synchronism therewith.

A separating roller 53 is rotatably provided in the separating roller shaft 54 via a torque limiter 62 for generating a predetermined torque. The separating roller 53 is disposed to face the sheet feeding roller 51. The separating roller 53 is configured to press the sheet feeding roller 51 with a predetermined retard pressure (separating pressure) provided by springs 73*a* and 73*b* (generically indicates as 73) via a bearing (not shown). A nip is formed between the separating roller 53 and the sheet feeding roller 51.

The torque generated by the torque limiter 62 and the retard pressure caused by the springs 73*a* and 73*b* of the separating roller 53 are set such that separating roller 53 is driven by friction against the sheet feeding roller 51 (i.e., the separating roller 53 remains stationary when the sheet feeding roller 51 is stationary), when there is only sheet in the nip formed by the sheet feeding roller 51 and the separating roller 53, or when there is no sheet in the nip. The torque and the retard pressure is also set such that the separating roller 53 is rotated in a reverse direction so as to generate a reverse pressure, when there are more than two sheets in the nip.

Figures 4, 5:
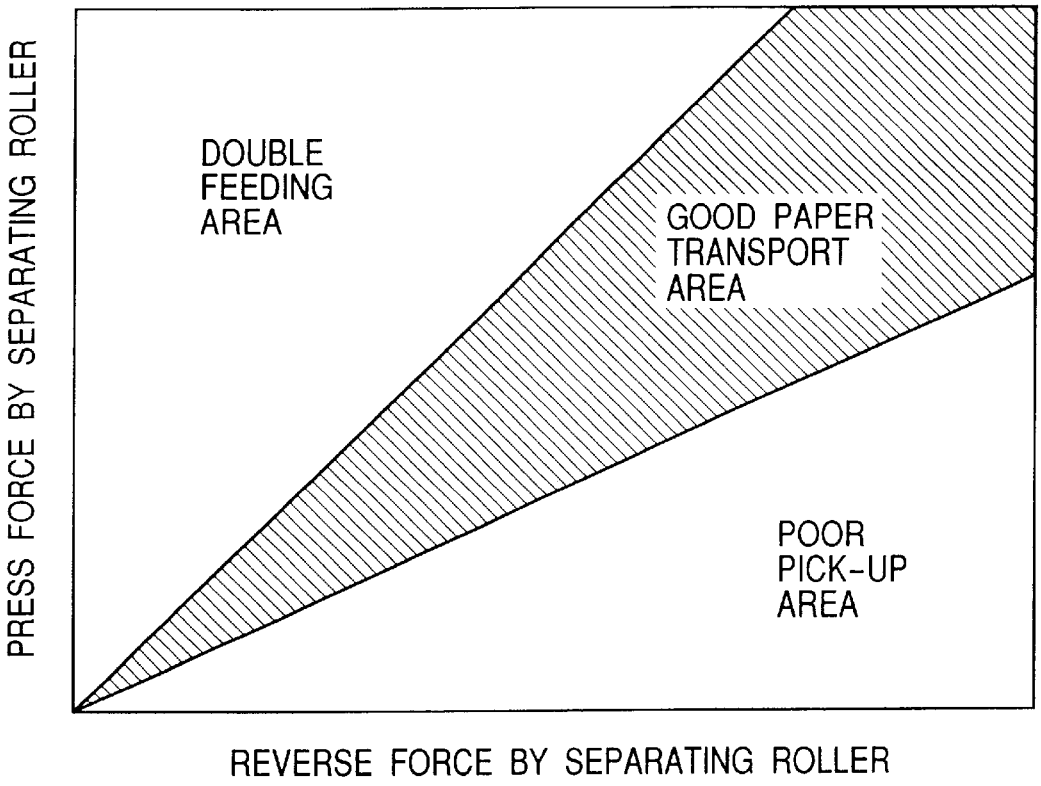
FIG. 4 is graph conceptually showing a relationship between a pressure force and a reverse force of a separating roller.
FIG. 5 is a table showing a result of experiment with respect to an angle of incidence of a sheet and stability in sheet feeding.

FIG. 4 is graph showing a correlation between the regard pressure in the separating roller 53 and the torque. The smaller the pressure force of the separating roller 53, and the greater the reverse force of the separating roller 53, a misfeed zone increases is enlarged. Conversely, the greater the pressure force of the separating roller 53 and the smaller the reverse force of the separating roller 53, a double feed zone is enlarged. The torque and the retard pressure is selected to reside in a proper sheet feeding zone.

In this respect, the torque limiter according to the embodiment is configured such that the reverse force exerted from the separating roller to the sheet is in a range between 2.53 N and 3.02 N (≅258 gf to 308 gf). The springs 73*a* and 73*b* are configured such that the pressure force exerted by the separating roller 3 against the sheet feeding roller 51 is in a range between 2.74 N and 3.33 N (≅280 gf to 340 gf).

In this embodiment, a roller having a diameter of 36 mm is used to construct the sheet feeding roller 51 and a roller of a diameter of 24 mm is used to construct the separating roller 53. Considering that the sheet is pressed against the sheet feeding roller 51, the diameter of the sheet feeding roller 51 is preferably larger than that of the separating roller 53.

The relative positions of the sheet feeding roller 51, the separating roller 53 and the middle plate 70 are closely related to stability in sheet feeding.

The nip is formed by contact between the sheet feeding roller 51 and the separating roller 53 occurring when the middle plate 70 causes the sheet to come into contact with the sheet feeding roller 51 for pick-up operation by using the sheet feeding apparatus according to this embodiment. An angle formed by a line extending from the nip and a line tangent to the sheet feeding roller 51 at a section where the sheet is in contact with the sheet feeding roller 51 is indicated as an angle $\alpha$ of incidence of the sheet in FIG. 2. Experiments with respect to angles $\alpha$ are performed to evaluate the angles $\alpha$ for stability of sheet feeding. FIG. 5 is a table that summarizes the result of evaluation.

Referring to FIG. 5, symbol "◎" indicates a level that ensures stable feeding of sheets of various materials. Symbol "o" indicates a level where, for a variety of materials, the leading edge of the subsequent sheet is led by the sheet feeding roller 51 and the separating roller 53 to eject from the nip, but where double feeding seldom occurs. Symbol "Δ" indicates a level where double feeding occurs for sheets formed of a material having a relatively large friction coefficient, but where double feeding seldom occurs for sheets referred to as plain paper. Symbol "x" indicates a level where double feeding occurs from time to time even when plain paper is used.

Figure 14B:
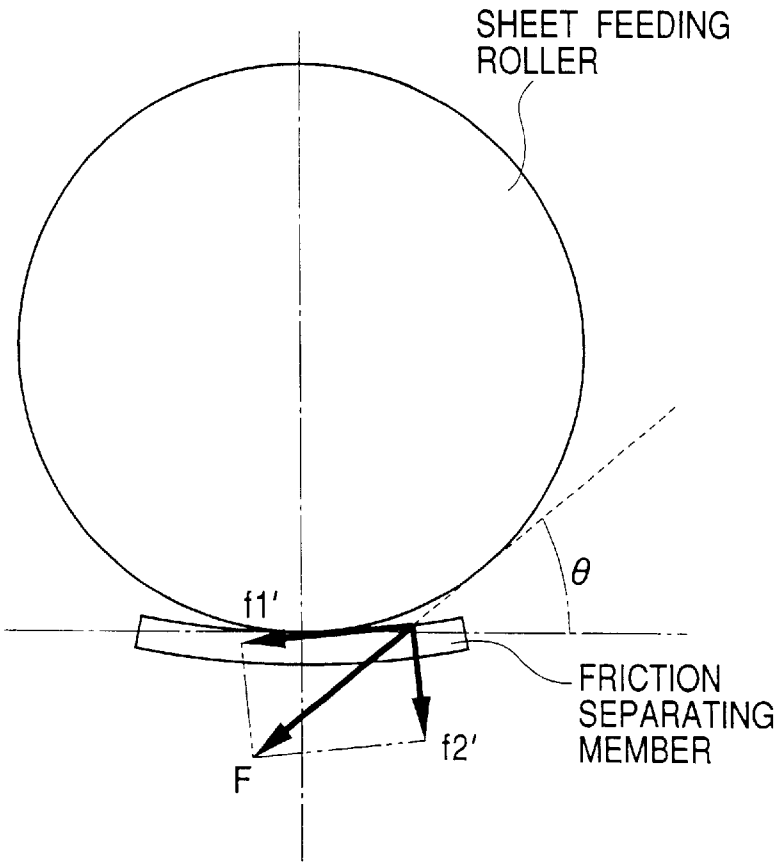
FIG. 14B is a conceptual figure showing a relation of forces arisen at sheet feeding part in a separation system which can be found in the conventional type of a sheet feeding part, the separation system utilizing a friction separating member contacting a sheet feeding roller at the sheet feeding part.
Figure 14A:
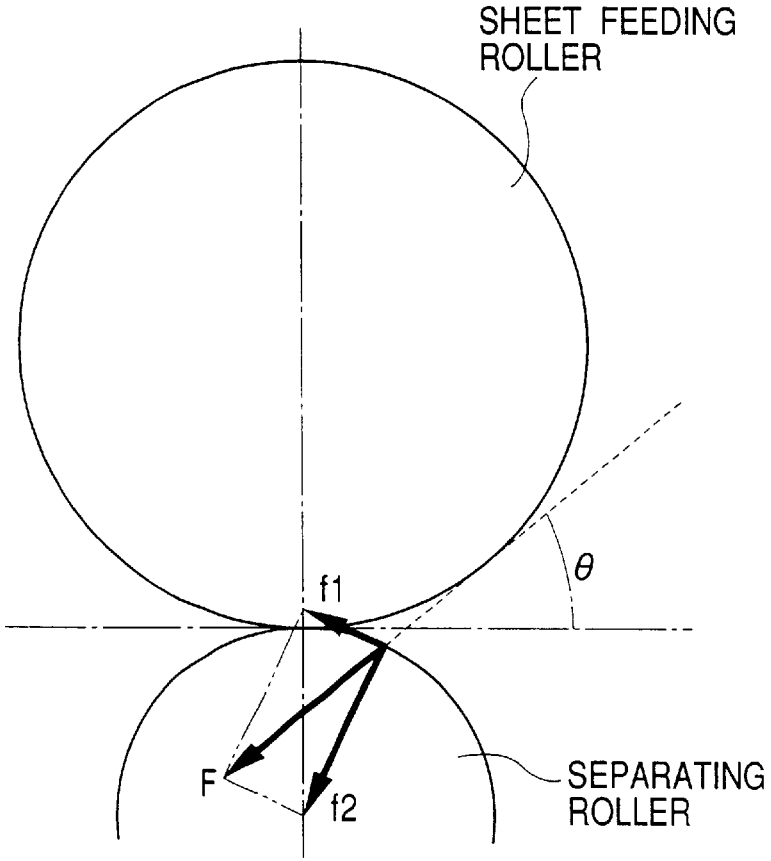
FIG. 14A is a conceptual figure showing a relation of forces arisen at sheet feeding part in the embodiment of the present invention.

FIG. 14A shows a relation of forces arisen at sheet feeding part in the embodiment of the present invention, while FIG. 14B shows a relation of forces arisen at sheet feeding part in a separation system which can be found in the conventional types of a sheet feeding part, the separation system utilizing a friction separating member contacting a sheet feeding roller at the sheet feeding part. In contrast, FIG. 14B is a conceptual figure showing a relation of forces arisen at sheet feeding part in a separation system which can be found in the conventional type of a sheet feeding part, the separation system utilizing a friction separating member contacting a sheet feeding roller at the sheet feeding part.

In FIGS. 14A and 14B, component forces shown as f1 and f1' mean forces which acts in an angle of incidence in which a sheet of paper is fed, the angle being in parallel to a nip line. Component forces shown as f2 and f2' mean forces which acts to push a separating roller down. In those forces, f1 and f2 in FIG. 14A are shown as components forces in the embodiment of the present invention, while f1' and f2' in FIG. 14B are shown as components forces in the conventional types of a sheet feeding part.

To compare component forces, f1 and f1', in the case that a paper is fed in the direction of $\theta$, f1 is smaller than f1', while f2 is larger than f2'. Since the component force f2 acts toward the direction to apart a separating roller from a sheet feeding roller, if f2 become large, it is raised, that a separating roller can not rotate by harmonizing with a sheet feeding roller, or that a separating roller can not rotate in the direction to make a sheet return back in the case that a plural sheets of papers are fed.

The problems introduced above cause faulty paper transport. Therefore, in order to produce a paper feeding apparatus having a high reliability (i.e. a stable paper feeding), it is important to set an angle of incidence in which a paper is fed appropriately in accordance with these dynamic conditions.

Naturally, the stability of sheet feeding is affected not only by the angle of incidence of the sheet but also other factors such as a configuration of a guide around the sheet feeding roller 51. It is true, therefore, that the experiment above does not provide a perfect evaluation. The experiment does reveal, however, that the middle plate 70 should be designed so that the angle of incidence should be equal to or smaller than $50\times(\pi/180)\text{rad}(=50°)$. The smaller the angle of incidence, the sheet can be fed without causing deformation therein. Thereby, stability of sheet feeding and separation is improved.

When the angle of incidence is increased, the sheet is deformed significantly around the sheet feeding roller 51. An extra resistance is encountered in feeding and separating the sheet, thus detracting from the stability. When the paper that does not tear easily (for example, cardboard) is fed, for example, the leading edge of the sheet may be entangled with the separating roller 53 or the separating roller 53 may be forced downward. Consequently, the likelihood of misfeed is increased.

The upper limit of the angle a of incidence of the sheet is determined as described above. A description will now be given of how the lower limit of the angle a is determined.

Figure 6:
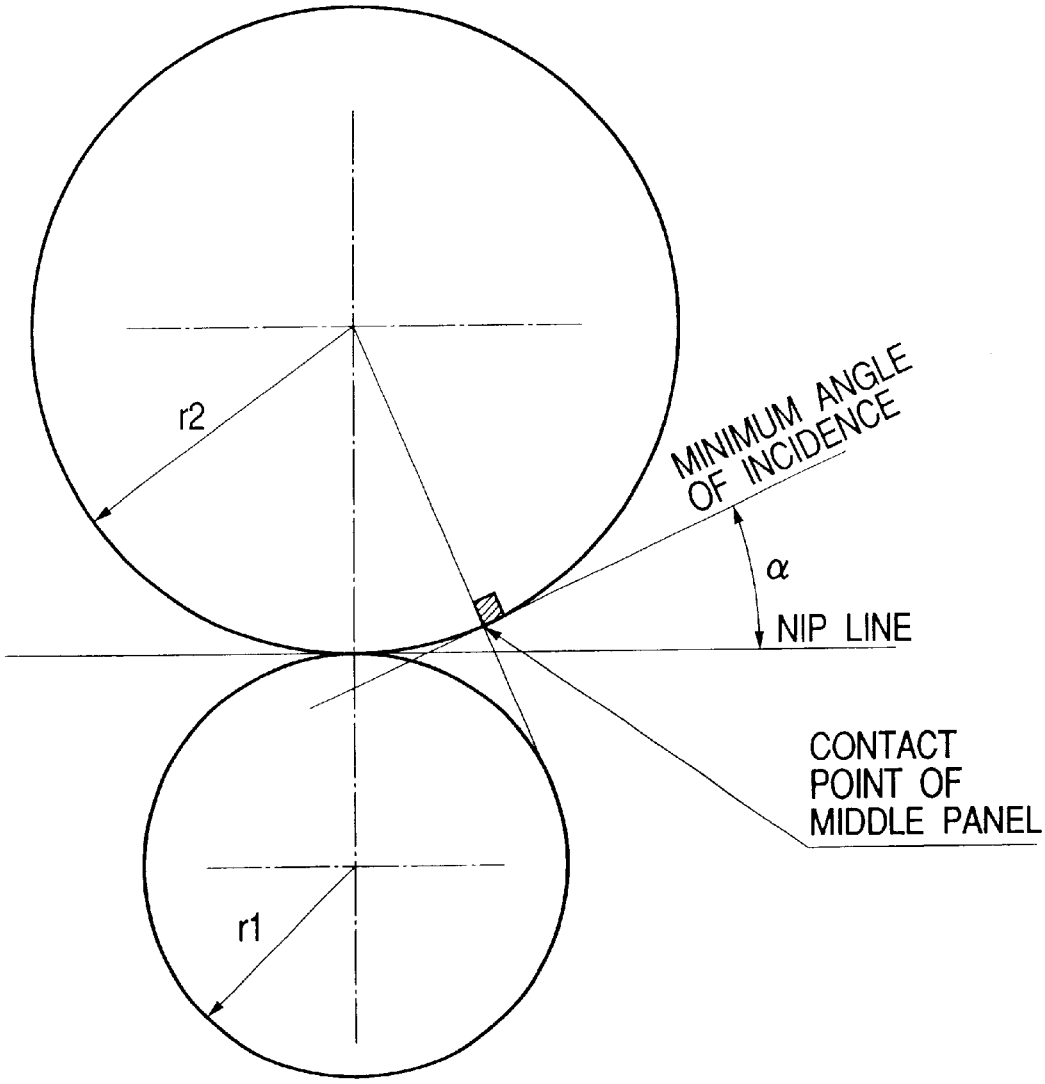
FIG. 6 is schematic diagram demonstrating how an angle of incidence of the sheet is set.

FIG. 6 schematically shows the rollers and the middle plate. A minimum angle of incidence is also shown.

In this model, it is assumed that a raising/lowering operation of the middle plate 70 is not rotated around a pivotal point. Instead, the middle plate 70 is assumed to be moved in a horizontal direction toward the sheet feeding roller 51 until it comes into contact with the sheet feeding roller 51 so that an angle, formed by a sheet carrying surface with respect to a level plane when the sheet feeding roller 51 and the middle plate 70 are removed from each other, is maintained. It is further assumed that the leading operation of the middle plate 70 does not interfere with the separating roller 53 as a result of coming into contact with the sheet feeding roller 51.

Figure 7:
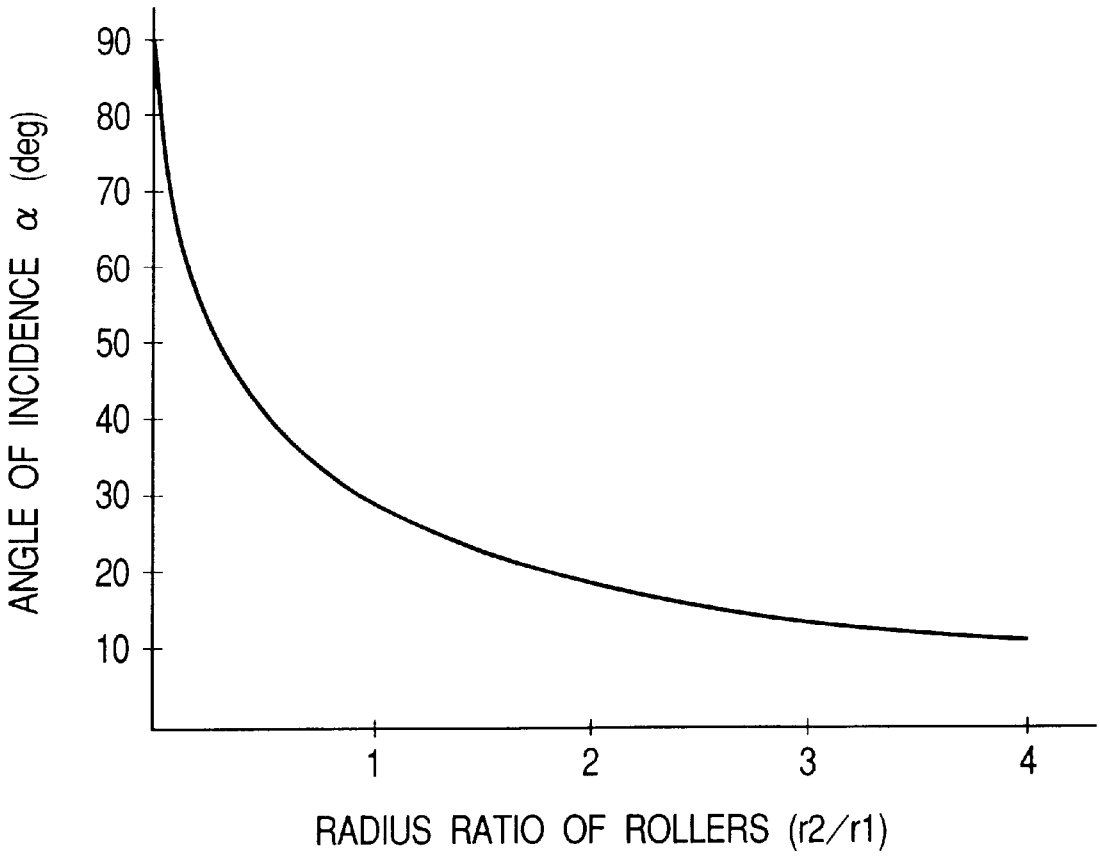
FIG. 7 is a graph showing a correlation between a radius ratio of rollers and the angle of incidence.

The condition described above is given by $\cos(90-\alpha)=r1/(r1+r2)$, where r2 denotes a radius of the sheet feeding roller, r1 denotes a radius of the separating roller and a indicates an angle of incidence of the sheet with respect to the nip line. FIG. 7 is a graph showing the relationship between a radius ratio r2/r1 of the rollers and the angle of incidence a.

Practical values are substituted into the graph. When the radius r1 of the separating roller 53 is too small, the leading edge of the sheet may easily be bent or torn. For this reason, the practical lower limit would be r1=8 mm.

In contrast, there is no marginal factor related to the feeding performance that determines the radius r2 of the sheet feeding roller 51. When the size of the roller is increased, however, the cost of production is increased and the scale of the apparatus becomes large. It is considered that the upper limit of the radius r2 is such that r2=30 mm. Substituting these figures into the equation above, the angle of incidence $\alpha$ is approximately $12\times(\pi/180)\text{rad}(=12°)$.

This figure is obtained from the model shown in FIG. 6. As already described, an assumption here is that the middle plate 70 is moved toward the sheet feeding roller 51 from a position of contact with the separating roller 53.

It is impossible, however, in view of apparatus design to provide the leading edge of the middle plate 70 is at the point of contact with the separating roller 53. Since the middle plate 70 is rotated around a pivotal point toward the sheet feeding roller 51, it is necessary to provide clearance so that the leading edge of the middle plate 70 does not interfere with the separating roller 53. Moreover, it is necessary to provide an operating margin considering requirement for reliability and stability of sheet feeding. Considering all this, the angle of incidence is preferably slightly larger than $12\times(\pi/180)\text{rad}(=12°)$. Experiments based on the graph of FIG. 7 reveal that a sufficient clearance is provided by increasing the angle of incidence $\alpha$ by $3\times(\pi/180)\text{rad}(=3°)$. Hence, it is preferable that the lower limit be set at $15\times(\pi/180)\text{rad}(=15°)$.

Accordingly, by setting the angle of incidence $\alpha$ such that $15\times(\pi/180)$ $(=15°)\leqq\alpha\leqq 50\times(\pi/180)\text{rad}(=50°)$, the sheet feeding operation and the separating operation are made stable and reliable.

A description will now be given of the driving of the sheet feeding unit. At a facing mating position the sheet feeding driven gear 65 is provided to mate with a control gear 80 having two notches 80*a* and 80*b* (see FIGS. 8A to 8G), the notches 80*a* and 80*b* not being involved in mating. The control gear 80 serves as driving force transferring means.

The control gear 80 is provided with a cam 80*c* (pressing and separating means) for pressing the sheet supported by the middle plate 70 against the sheet feeding roller 51 or releasing that pressure.

A cam follower 70*c* (pressing and separating means) is integrally formed at a rear end of the middle plate 70 so as to extend beyond a hole 64*a* in the rear side plate 64 to come into contact with the cam 80*c*. With this, clockwise (see FIG. 2) rotation of the middle plate 70 is prevented.

The control gear 80 is fixed to a driving shaft 90, which is provided with a spring clutch 68 (controlled rotation means). The spring clutch 68 is driven into a rotation by turning a control solenoid 69 on for a period of time T1 (sec). The phase angle of the spring clutch 68 and the notch 80*a* are selected so that, normally, the notch 80*a* of the control gear 80 is opposite to the sheet feeding driving gear 65.

With this construction, at an initial state, a rotational load from the torque limiter 62 is exerted to the sheet feeding driving gear 65, the sheet feeding roller shaft 52 and the sheet feeding roller 51 such that all of these components are free to rotate although the rotating load of torque limiter 62 operates.

Downstream from the sheet feeding roller 51 in the direction of sheet feeding is provided a pull roller pair 55 (transporting means). A driving shaft of a pull-driving roller 55*a* constituting the pull roller pair 55 is rotatably supported by the front plate 63 and the rear plate 64 via bearing members (not shown). At an end of the driving shaft is provided a pull clutch 60 implemented by an electromagnetic clutch capable of connecting a driving force from a pull motor M2 to the driving shaft or disconnecting the driving force from the driving shaft, via gears 59 and 60*a*.

A pull-driving roller 55*b* constituting the pull roller pair 55 is pressed against the pull-driving roller 55*a* by springs 56*a* and 56*b* (generically indicated as 56) via bearing members (not shown).

Between the separating roller 53 and the middle plate 70 is fixed a separation guide 78 that serves as a block encountered by the sheet set by the user in the sheet feed tray. The separation guide 78 also serves as a sheet guide. At a leading edge of the separation guide 78 is provided an auxiliary separation guide 75, formed of a thin plate such as a polyethylene sheet or a SUS member, for guiding the leading edge of the sheet to the nip formed between the sheet feeding roller 51 and the separation roller 53.

With this construction, the leading edge of the sheet is prevented from folding or bending by coming into contact with the separating roller 53.

A detailed description will now be given of a construction of a transmission means and a pressing and separating means in the sheet feeding roller 51 and the middle plate 70.

As described already, the control gear 80 is provided to be opposite to the sheet feeding driving gear 65, the control gear 80 being integrally formed of a first gear part 80*d*, a second gear part 80*e*, the two notches 80*a* and 80*b*, and the cam 80*c* for pressing the middle plate 70 against the sheet feeding roller 51 and releasing that pressure. The first and second gears 80*d* and 80*e* are mated with the sheet feeding driving gear 65.

The control gear 80 as described already is driven into rotation by the spring clutch 68 and the solenoid 69. The construction of the spring clutch 68 is not the subject matter of the present invention so that a detailed description thereof is omitted.

The phase angle of the spring clutch 68 and a configuration and a position of the first notch 80*a* are selected such that the first notch 80*a* is opposite to the sheet feeding driving gear 65 at an initial state of the control gear 80. Thus, the sheet feeding roller shaft 52 is rotatable in a transporting direction or in a reverse direction.

The cam 80*c* is into contact with the cam follower 70*c* provided at the end of the middle plate 70. The cam configuration and the phase angle with respect to the notch 80*a* are selected such that the middle plate 70 is removed from the sheet feeding roller 51 against a force provided by the urging spring 72 at an initial state.

With this construction, it is ensured that, when the user sets a bundle of sheets, the pressure on the middle plate 70 against the sheet feeding roller 51 is removed so that the bundle of sheets can be easily set until it comes into contact with the separation guide 78.

A description will now be given of the sheet feeding operation and the separating operation performed by the transferring means, and the pressing and separating means.

By turning the solenoid 69 on for T1 (sec), the spring clutch 68 drives the control gear 80 into rotation. The control gear 80 starts rotating in a counterclockwise direction (see FIG. 8) so that the cam 80*c* is rotated by an angle θ1 to reach a position where a pressure against the middle plate 70 starts to be exerted.

Figure 8A:
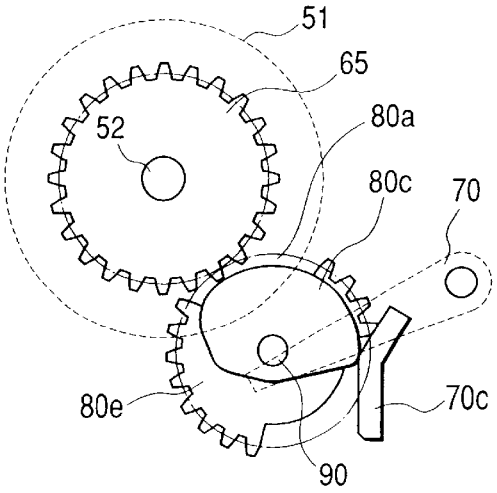
FIGS. 8A, 8B, 8C, 8D, 8E, 8F and 8G show statuses at the time of controlling control gears according to the embodiment of the present invention.
Figure 8B:
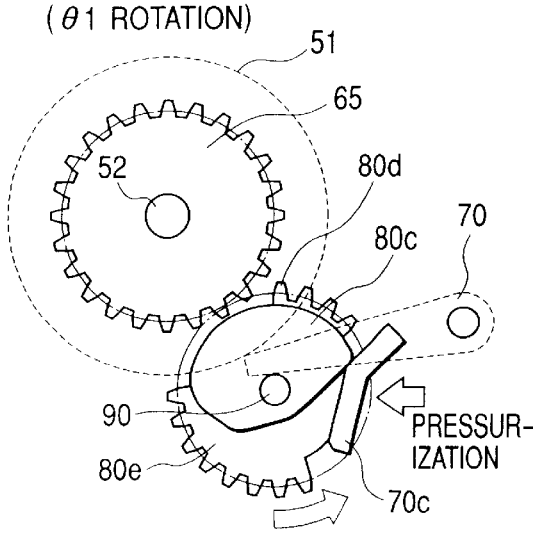
Figure 8C:
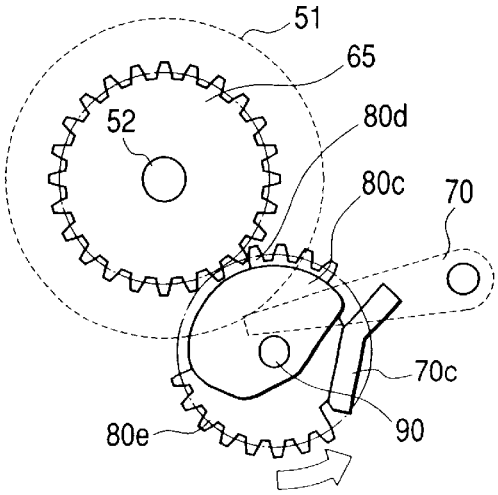
Figure 8D:
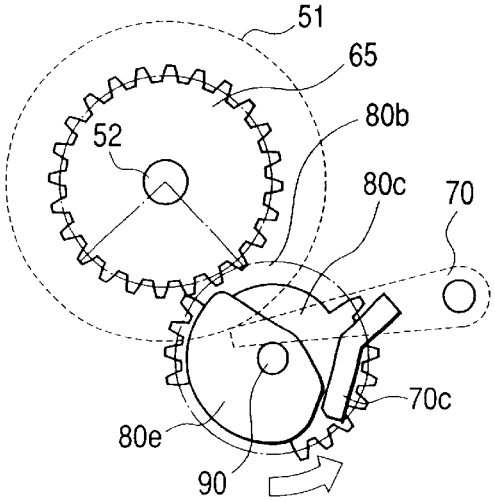
Figure 9A:
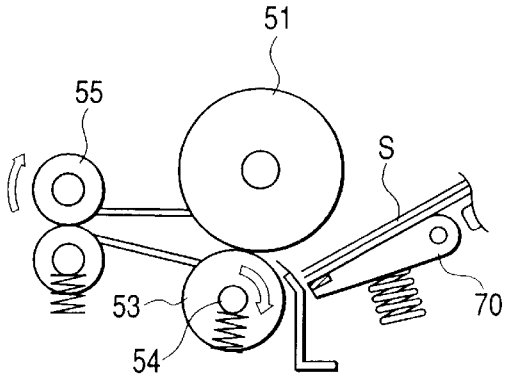
FIGS. 9A, 9B, 9C, 9D, 9E, 9F, 9G and 9H show statuses of a sheet feeding unit according to the embodiment of the present invention.
Figure 9B:
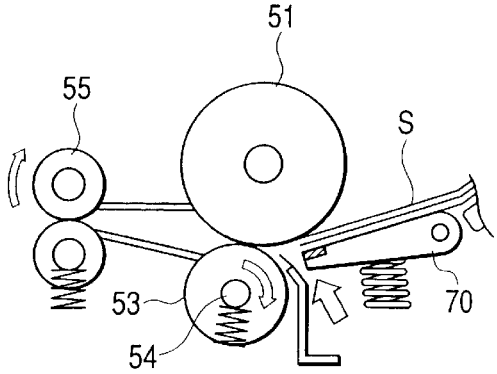
Figure 9C:
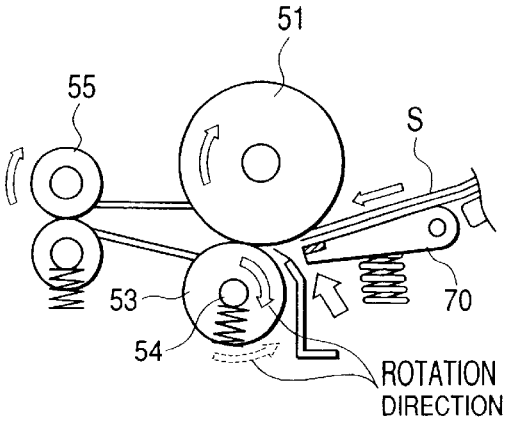
Figure 9D:
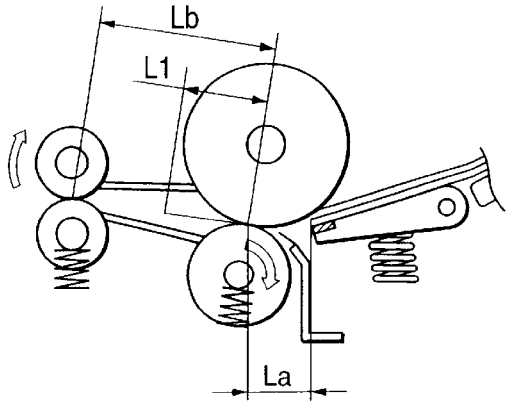

The cam 80*c* and the cam follower 70*c* are removed from each other so that the middle plate 70 is pressed against the sheet feeding roller 51. With this, the topmost sheet S of the sheet bundle carried in the sheet feeding tray 74 is pressed against the sheet feeding roller 51 (FIGS. 8B and 9B).

When the control gear 80 is rotated until an angle θ2 is swept, the first gear part 80*d* provided in the control gear 80 is mated with the sheet feeding driving gear 65 so that the sheet feeding driving gear 65 is rotated at a predetermined angle $A\times(\pi/180)\text{rad}(=A°)$.

As a result of this rotation, the sheet feeding roller 51 is rotated by A° so that the topmost sheet S of the sheet bundle is fed forward by a feeding distance L1 (mm) (hereinafter, the sheet feeding operation described so far will be referred to as pre-feeding operation) (FIGS. 8C, 8D and FIGS. 9C, 9D).

The feeding distance L1 is given by in the case when an outside diameter of the sheet feeding roller 51 is D (mm):

$$L1=A\times\pi\times D/360 \quad \text{(Equation 1)}$$

The feeding distance L1 of the pre-feeding operation is controlled to be larger than a distance La (mm) from the sheet separation guide 78 to the nip formed by the sheet feeding roller 51 and the separating roller 53 and smaller than a distance Lb (mm) from the nip to the pull roller pair 55, by controlling the number of teeth of the first gear part 80*d*.

A speed of rotation of a sheet feeding motor M1, the number of teeth of a transmitting gear 68*a* for transmitting a driving force of the motor M1 and the diameter of the pull roller pair 55 are selected such that a speed of rotation of the sheet feeding driving gear 65 is set to ensure that a speed of sheet feeding provided by the sheet feeding roller 51 approximates a speed of feeding provided by the pull roller pair 55 and a registration roller pair 81.

When the control gear 80 continues to rotate until an angle θ3 is swept so that the second notch 80*b* is opposite to the sheet feeding driving gear 65 (FIGS. 8D and 9D), the driving force is no longer delivered to the sheet feeding driving gear 65. Consequently, the rotation of the sheet feeding roller 51 is suspended.

The number of teeth of the first gear 88*d* is selected as described above. Thus, the leading edge of the sheet S, fed by the distance L1 by the pre-feeding operation, is temporarily held between the nip and the pull roller pair 55, irrespective of where the feeding of the sheet S is started.

Figure 8E:
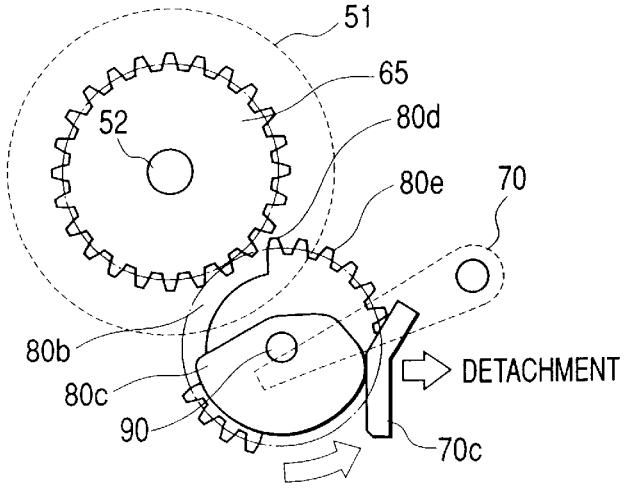
Figure 8F:
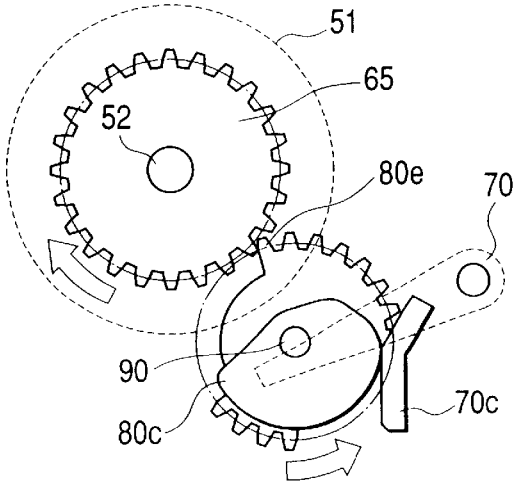
Figure 8G:
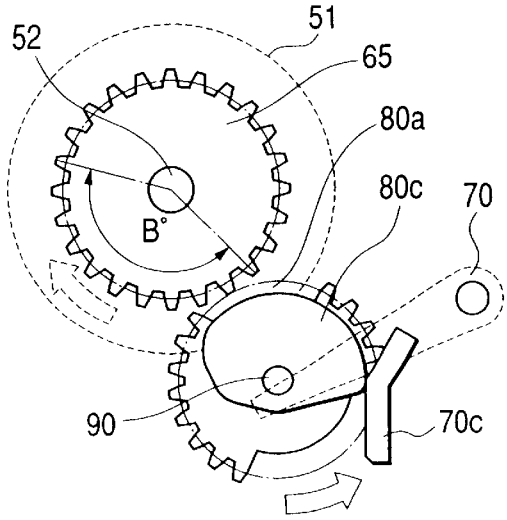
Figure 9E:
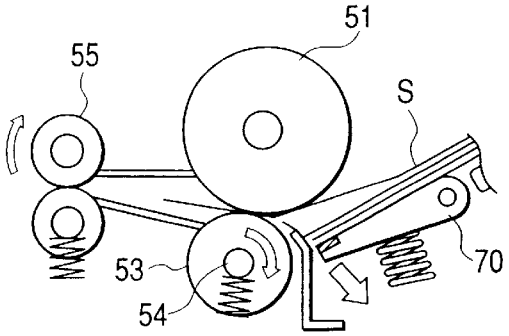

Thereafter, the control gear 80 is rotated until an angle θ4 is swept and the cam 80*c* is returned to the position where the middle plate is removed from the sheet feeding roller 51, the camp 80*c* and the camp follower 70*c* come into contact with each other so that the pressure to the middle plate 70 against the sheet feeding roller 51 is released (FIGS. 8E and 9E).

The duration of suspension of rotation of the sheet feeding roller 51 is set as separating operation time to ensure that the double-fed sheet S fed by the pre-feeding operation by the distance L1 is properly returned to the middle plate 70.

Figure 9F:
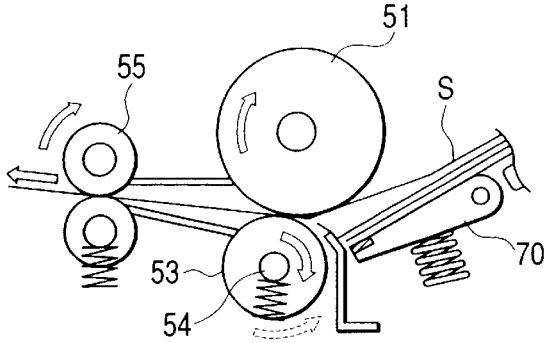

When the control gear 80 is rotated until an angle θ5 is swept and the second gear part 80*e* of the control gear 80 is mated with the sheet feeding driving gear 65 (FIGS. 8F and 9F), the rotation of the sheet feeding driving gear 65 is resumed.

The sheet feeding roller 51 is rotate by a predetermined angle $B\times(\pi/180)\text{rad}(=B°)$. As a result of this rotation, the sheet feeding operation by the sheet feeding roller 51 is resumed (hereinafter, this sheet feeding operation subsequent to the pre-feeding operation will be referred to as second sheet feeding).

In the second sheet feeding, the sheet feeding roller 51 is fed by a distance L2 (mm) given below $$L2=B\times\pi\times D/360 \quad \text{(Equation 2)}$$

The distance L2 by which the sheet is fed by the second sheet feeding is controlled according to the number of teeth of the second gear part 80*e* to ensure that the leading edge of the sheet S, fed to a position adjacent to the pull roller pair 55 as a result of the pre-feeding operation, properly reaches the pull roller pair 55 but does not reach the registration roller pair 81.

The distances L1 and L2 will be described after the description of the entirety of sheet feeding operation.

Figure 9G:
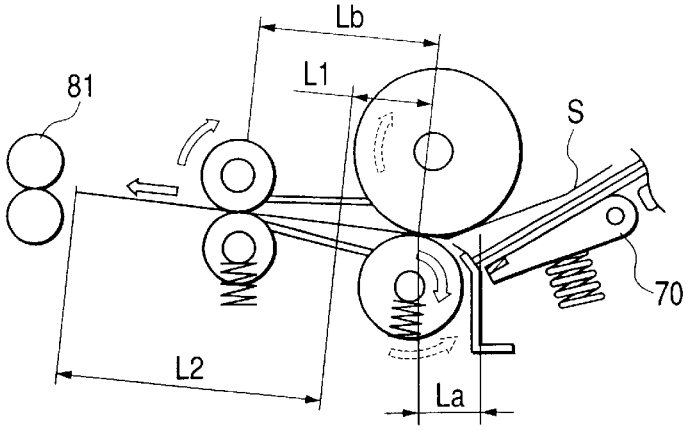

When the control gear 80 is rotated further until the first notch 80*a* is opposite to the sheet feeding driving gear 65, the driving force is no longer exerted to the sheet feeding driving gear 65 so that the driving force is not delivered to the sheet feeding roller 51. The control gear 80 terminates its rotation and stops at the initial position (states of FIGS. 8G and 9G).

A description will now be given of a reason why the pre-fed sheet S is temporarily held before reaching the pull roller pair 55. While the sheet is temporarily held, the rotation of the sheet feeding roller 51 is suspended because the control gear 80 is not mated with the sheet feeding driving gear 65.

In this state, the sheet S, having been fed by the distance L1, remains stationary. The cam 80*c* comes into contact with the cam follower 70*c* to lower the middle plate 70. Any double-fed sheet S fed by the pre-feeding operation is removed by the separating roller 53 while the sheet S remains at the nip between the sheet feeding roller 51 and the separating roller 53. Thereafter, the sheet feeding roller 51, which is prevented from rotation for a predetermined period of time, resumed the sheet feeding operation so as to transport the sheet S as far as the pull roller pair 55.

By holding the sheet S temporarily, the a sequence of sheet feeding operation, including the pre-feeding and second sheet feeding, can be properly timed on a constant basis. With this, the stability of sheet transportation is improved.

Since the sheet S is stationary when the pressure to the sheet, supported by the middle plate 70, is released. The position of the leading edge of the sheet S is controlled with high precision. The distance between the pull roller pair 55 and the nip between the sheet feeding roller 51 and the separating roller 53 can be reduced. Consequently, the size of the apparatus is reduced.

By stopping the sheet S temporarily, the time required for separating the sheet can be secured. Since the separating operation is performed after the middle plate 70 is removed from the sheet feeding roller 51, successful and stable sheet separation is ensured.

Figure 10:
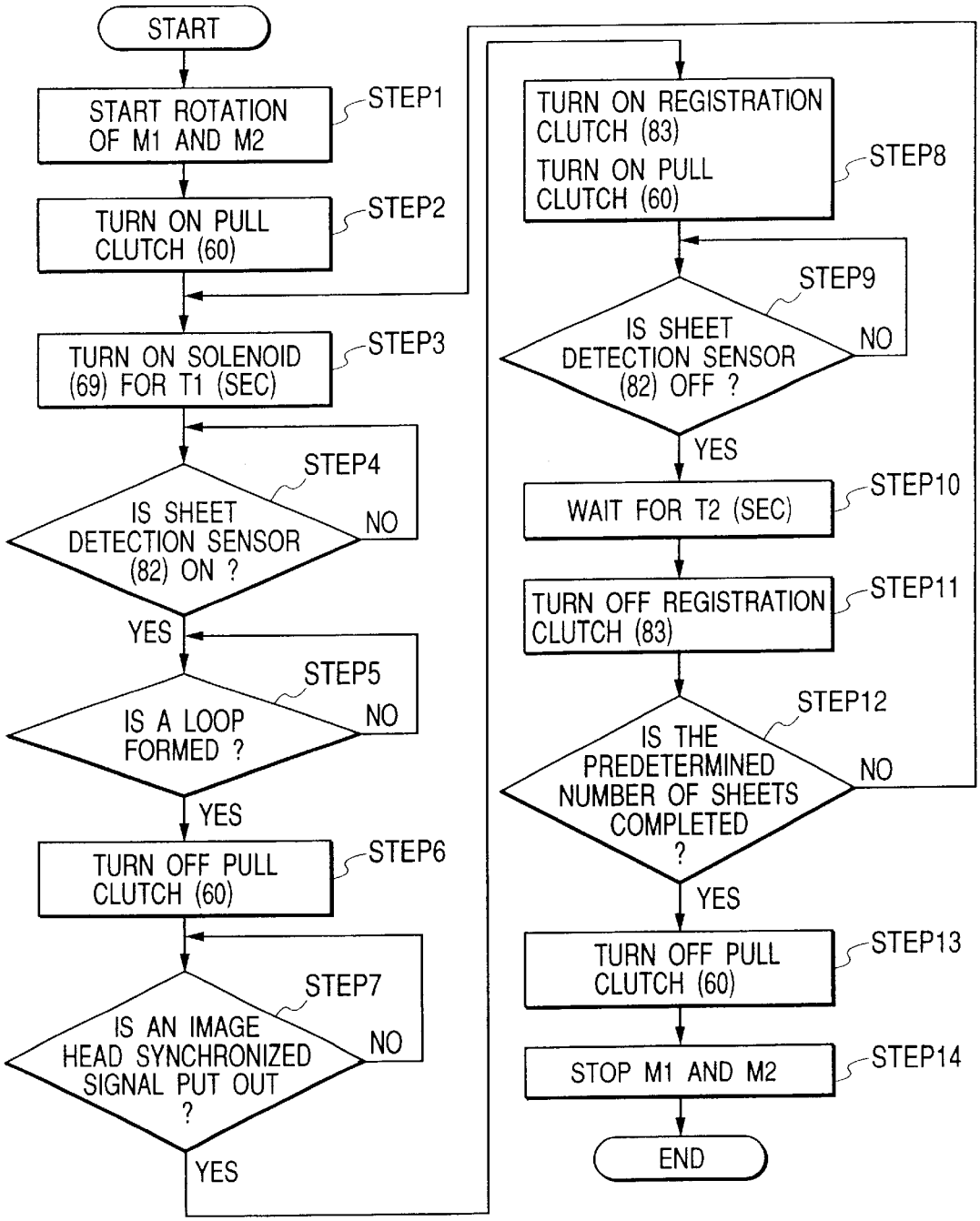
FIG. 10 is a flowchart showing an operation performed in manual sheet feeding according to the embodiment of the present invention.
Figure 11:
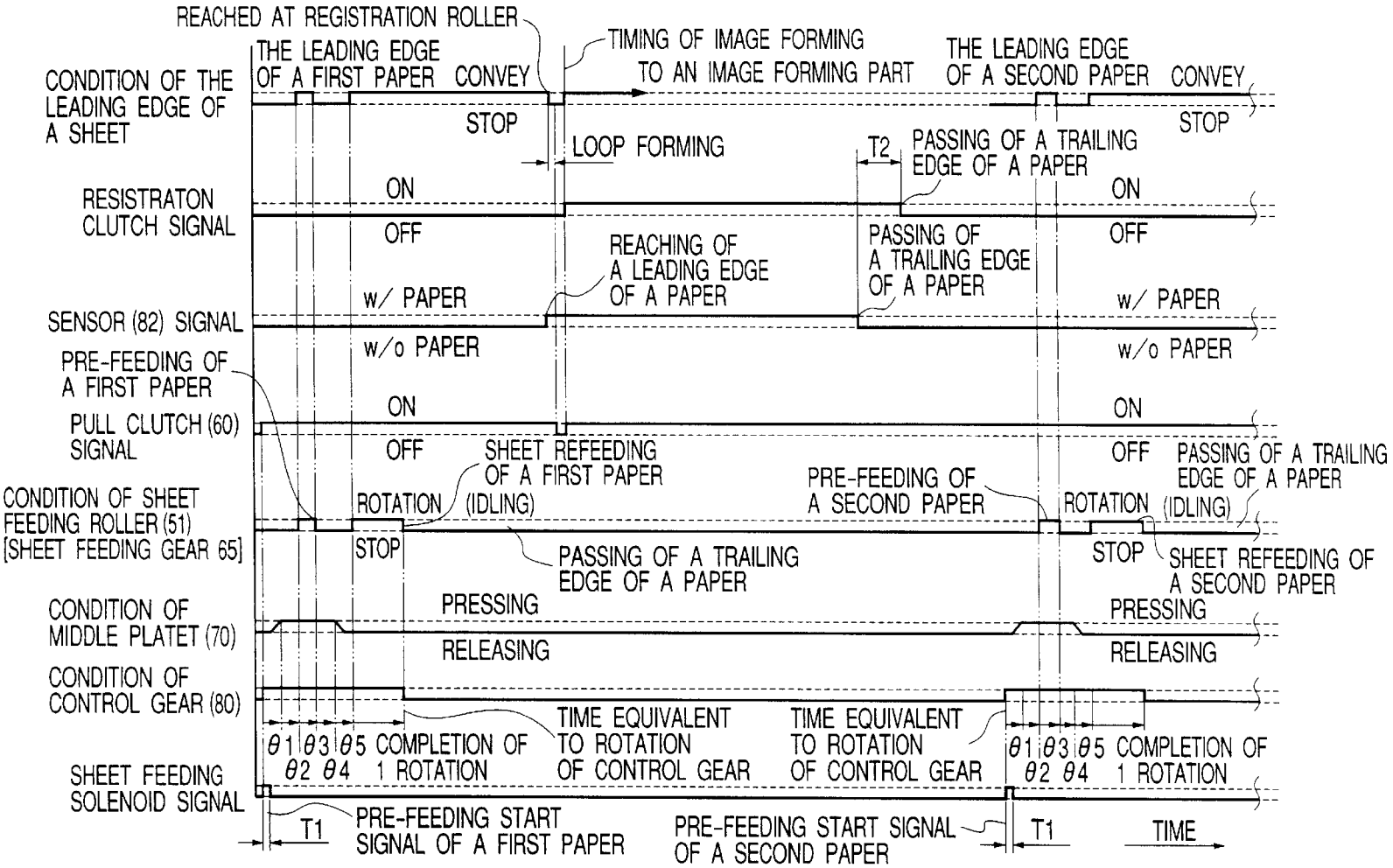
FIG. 11 is a timing chart of the operation performed in manual sheet feeding according to the embodiment of the present invention.

The sheet feeding operation by the multi-feeding units will now be described with reference to a flowchart of FIG. 10 and a timing chart of FIG. 11.

When a start button (not shown) is depressed while the bundle of sheet is carried on the sheet feeding tray 74, the pull motor M2 and the sheet feeding roller M1 start their rotation (step 1). A CPU 40 (see FIG. 1) supplies a signal for turning the pull clutch 60 on (step 2).

After a predetermined period of time, a signal from the CPU 40 turns the solenoid 69 on for T1 (sec) (step 3) so that the rotation of the control gear 80 is started. As described above, with this operation, the sheet supported by the middle plate 70 is pressed against the sheet feeding roller 51.

The sheet feeding roller 51 is rotated by $A\times(\pi/180)$rad(= A°) so that the topmost sheet S carried on the tray 74 is forced forward by the predetermined distance L1 due to the pressure by the middle plate 70 and the surface friction on the sheet feeding roller 51 (pre-feeding operation).

Since the separating roller shaft 54 is rotated in synchronism with the sheet feeding roller shaft 52 in the same direction as the direction of sheet transportation, a reverse force forcing the separating roller 53 backward is provided by the torque generated by the torque limiter 62.

Before the sheet advances as far as the nip between the sheet feeding roller 51 and the separating roller 53, or when a single sheet is fed successfully, the friction that rotates the separating roller 53 in the direction of transportation exceeds the reverse force so that the separating roller 53 is rotated in the direction of sheet feeding along with the sheet feeding roller 51.

In contrast, when more than one sheet is fed (double-feeding) one on top of the other, the reverse force exceeds the friction so that the separating roller 53 operates to force the double-fed sheet backward.

When the double-feeding of the sheet occurs in the pre-feeding operation, the separating roller 53 operates to force the double-fed sheet backward. Without the arrangement described above, the middle plate 70 may be urged by the urging spring 72 to press the sheet feeding roller 51, causing the separating operation by the separating roller 53 to be thwarted and preventing the double-fed sheet from being forced backward. By suspending the rotation of the sheet feeding roller 51 by rotating the control gear 80, the cam 80*c* and the cam follower 70*c* operate to remove the middle plate 70 from the sheet feeding roller 51.

By suspending the feeding operation before releasing the pressure from the middle plate 70, the pressure release is properly timed in the construction where the middle plate 70 is elevated and lowered by the cam 80*c*, irrespective of the number of sheets carried. Therefore, the sheet feeding operation is stabilized.

When the control gear 80 is rotated further, the sheet feeding roller 51 starts the sheet feeding operation so that the transportation of the sheet S is resumed to transport the leading edge of the sheet S to the pull roller pair 55 properly.

After the sheet is transported by the distance L2 due to the second sheet feeding operation by the sheet feeding roller 51, the control gear 80 completes one rotation and the transmission of the driving force to the sheet feeding roller 51 is terminated. The rotation of the pull roller pair 55 is continued to transport the sheet S to the registration roller pair 81.

In this state, the first notch part 80*a* of the control gear 80 is opposite to the sheet feeding driving roller 65 so that no load is imposed on the sheet feeding roller 51. A rotating force is exerted by the sheet S to the sheet feeding roller 51 as the sheet is transported by the pull roller pair 55. The sheet feeding roller 51 continues to rotate in a loose state until the trailing edge of the sheet S is clear of the nip between the sheet feeding roller 51 and the separating roller 53.

In this pulling operation, the middle plate 70 is removed from the sheet feeding roller 51. The sheet to be fed next does not receive a friction force from the sheet S already pulled. It is unlikely that double feeding occurs in this situation. If the sheet happens to be fed, however, double-feeding is properly prevented. More specifically, the separating roller shaft 54 connected to the sheet feeding roller shaft 52 continues to be rotated in the direction of sheet feeding while the sheet feeding roller 51 is being rotated. The middle plate 70 is prevented from pressing the sheet feeding roller 51 and is removed therefrom. The torque limiter 62 operates to start a reverse rotation of the separating roller 53 so as to force the double-fed sheet backward.

When the sheet is stuck in the nip between the sheet feeding roller 51 and the separating roller 53, or when a paper jam occurs due to some malfunction or the like while the sheet is located at the nip between the pull roller pair 55, the sheet feeding roller 51 is free to rotate in any direction since the non-mating part of the control gear 80 is opposite to the sheet feeding driving gear 65. For this reason, the jammed sheet can be pulled in a direction reverse to the direction of transportation. Thus, the paper jam can efficiently attended to.

The benefit described above derives from providing the control gear 80 with portions without teeth and from connecting the sheet feeding roller 51 and the separating roller 53 to be driven in association. While the sheet feeding driving gear 65 is mated with the control gear 80, the sheet feeding roller 51 is prevented from rotating in the direction opposite to the direction of transportation. The separating roller shaft 54 is always provided with a driving force opposite to the direction of transportation. There is no need to provide a one-way clutch or the like for prevention of rotation.

While the sheet feeding driving gear 65 is not mated with the control gear 80, the sheet feeding roller shaft 52 is free to rotate either in the direction of transportation or in the reverse direction. Therefore, the jammed sheet can be pulled out easily in the reverse direction.

While the sheet is being pulled by the pull roller pair 55, the sheet feeding roller 51 is rotated in association. This rotation in a loose state is transmitted to the separating roller shaft 54 via the pulley 57 so that the rotation of the separating roller 53 is maintained to force the sheet backward.

As a result of the operation described above, the leading edge of the sheet S is transported to the nip at the registration roller pair 81 in a stationary state. As shown in FIG. 2, upstream from the registration roller pair 81 is provided a sheet sensor 82 implemented, for example, by a photointerpreter.

Figure 9H:
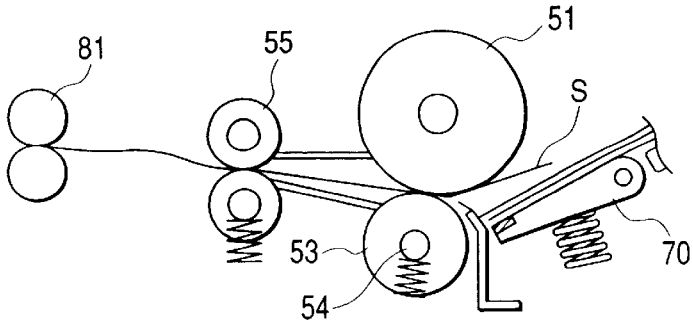

The sheet sensor 82 detects the leading edge of the sheet S (step 4). A timer means (not shown) provided in the CPU 40 counts time corresponding to a distance from the sensor 82 and the registration roller pair 81. With this, a signal for controlling the pull clutch 60 is output to form an appropriate loop (FIG. 9H) between the pull roller pair 55 and the registration roller pair 81 (step 6).

The loop is known in the art as a means to correct diagonal sheet feeding. A signal synchronized with an edge of an image and generated by the photosensitive drum 12 or the optical device registering the image, causes the registration roller pair 81 to rotate so that the sheet S is transported to a location above the photosensitive drum 12. A toner image is then transferred to the surface of the sheet.

After a predetermined period of time T2 (sec 9 elapses) since the trailing edge of the sheet S is clear of the sheet sensor 82 and is properly clear of the nip at the registration roller pair 81, the registration clutch 83 (see FIG. 2) is turned off (steps 9, 10 and 11). The sheet S having the toner image transferred thereon has its image fixed by the fixer 22 before being ejected to the ejection tray 25.

Subsequently, the above operations are repeated until a specified number of sheets have been processed (step 12). When the specified number of sheets have been processed, the pull clutch 60 is turned off (step 13), the sheet feeding motor M1 and the pull motor M2 are stopped (step 14).

A description will now be given of a condition for ensuring stable sheet feeding operation in the sheet feeding apparatus according to the embodiment described above.

One requirement is for the angle (angle of incidence of sheet) formed between the extension from the nip and the line tangential to the sheet feeding roller 51. The description concerning this is omitted here since it is already given.

A description will now be given of a total distance; i.e., sum of the distance L1, by which the sheet is fed by the sheet feeding roller 51 in the pre-feeding operation, and the distance L2, by which the sheet travels in the second sheet feeding. The sum should satisfies the condition given by $$L1+L2<L\min \quad \text{(Equation 3)}$$

$$L1+L2>(La+Lb)/0.8+10 \text{ (mm)} \quad \text{(Equation 4)}$$

where La denotes a distance between the leading edge of the sheet carried on the sheet feeding tray 70 and the center of the nip between the sheet feeding roller 51 and the separating roller 53, Lb denotes a distance between the center of the nip and the pull roller pair 55 and Lmin (mm) denotes a length of the smallest length of the sheet conceivably fed by the sheet feeding apparatus (see FIGS. 9A to 9H).

Equation 3 indicates that the total distance of transportation by the sheet feeding roller 51 should be smaller than the smallest length subject to transportation. Unless the condition is satisfied, when a plurality of sheets of the length Lmin are fed to the nip between the sheet feeding roller 51 and the separating roller 53, a second one of the plurality of sheets is transported by a distance L1+L2−Lmin at the same as a first one of the plurality of sheets is clear of the nip. When this is repeated, the jam caused by premature transportation or double-feeding is caused.

Equation 4 indicates a distance of the sheet feeding roller 51 a theory requires to ensure that stable sheet feeding is maintained even when the serviceability of the sheet feeding roller 51 is decreased with use so that the efficiency of transportation is decreased.

0.8 in equation 4 indicates a minimum efficiency of transportation (80%); 10 indicates a marginal length of the leading edge of the sheet (10 mm) to be sandwiched by the pull roller pair 55 when the transportation by the sheet feeding roller 51 is completed. The minimum length with this magnitude is necessary considering that there might be a situation where the leading edge of the sheet may not be properly captured by the pull roller pair 55. More specifically, it indicates a distance from the leading edge of the sheet to the nip of the pull roller pair 55 occurring when the transportation is completed.

In the sheet feeding apparatus of the retard separation system, the separating roller 53 receives a reverse driving force. Hence, the efficiency of transportation of the sheet feeding roller 51 is generally on the order of 90% even with a brand new apparatus.

The efficiency is decreased as the sheet feeding roller 51 wears with time. However, the efficiency does not drop at a regular rate. Beyond a certain margin, the sheet feeding roller 51 causes a slip so that it is no longer capable of transportation (if the slip occurs, it is considered that its life has expired).

The marginal transportation efficiency (80%) in equation above is required since a material generally used in the sheet feeding roller has a marginal efficiency of 80% or more, and it is required by design that the marginal transportation efficiency in the general image forming apparatus is 80%.

A description will now be given of how the speed of reverse feeding operation by the separating roller 53 is set. According to the construction of the embodiment described above, the load provided by the torque limiter 62 is imposed on the sheet feeding roller 51 via the joint driving parts (pulley) 57, 58 and 61, as well as to the separating roller 53, when the transportation by the sheet feeding roller 51 is completed so that the pull roller pair 55 becomes an agent of transportation.

The load (1+V2/V1)×Ft is imposed on the pull roller pair 55 and encountered when pulling the sheet from the nip between the sheet feeding roller 51 and the separating roller 53, where Ft (N) denotes a reverse force provided by the separating roller 53 to the sheet, V1 (mm/sec) denotes a circumferential speed of the sheet feeding roller 51, V2 (mm/sec) denotes a circumferential speed of the separating roller 53 in the reverse direction.

Due to this load, and considering the durability of the pull roller pair 55 and the load exerted to the motor M2 for driving the pull roller pair 55, it is preferable that the speed of reverse rotation of the separating roller 53 can be controlled at a minimum level to a feeding speed of the sheet feeding roller 51 while not detracting from the sheet feeding performance is maintained.

In this place, similarly as the above description, in the case where L1 denotes a sheet transporting distance in the pre-feeding operation, Lmin denotes a length of the smallest length of the sheet conceivably fed, and s denotes a safety factor for double-fed sheet, the speed condition of the separating roller 53 enough to maintain a sheet feeding stability in the sheet feeding apparatus according to this embodiment is given by $$V2 \leqq s\times(L1/(L\min-L1)\times V1 \quad \text{(Equation 5)}$$

In the pre-feeding operation, the middle plate 70 is pressed against the sheet feeding roller 51 so that the friction between the middle plate 70 and the sheet feeding roller 51 subtracts from the reverse force for forcing sheet, in contrast with the stage at which the middle plate is removed from the sheet feeding roller 51. Therefore, double-feeding is comparatively easy to occur during the pre-feeding operation.

Extension of the subsequent, extra sheet beyond the nip, between the sheet feeding roller 51 and the separating roller 53, occurring during the pre-feeding operation after removing the middle plate 70 is referred to as an overrun. An overrun should be canceled properly by forcing the extra sheet backward accordingly.

Equation 5 indicates the condition to be introduced to ensure this cancellation. More specifically, the equation 5 that the separating roller 53 is required to be rotated at the specified speed to cancel the maximum overrun (=L1) of the extra sheet after the second sheet feeding is resumed and before the trailing edge of the shortest sheet is clear of the nip between the sheet feeding roller 51 and the separating roller 53; i.e., while the separating roller 53 is driven for a minimum period of time.

In this equation, a safety factor of s is introduced. Assuming that the separating roller 53 forces the sheet backward at a 100% efficiency, the safety factor is set at 1 for a case where L1, the maximum overrun distance, is canceled to force the extra sheet backward as far as the nip between the sheet feeding roller 51 and the separating roller 53. By increasing the safety factor, the theoretical distance by which the separating roller 53 can force the sheet backward is extended accordingly. Double feeding is prevented more properly.

When the torque provided by the torque limiter, the retard pressure of the separating roller 53 and the angle of the middle plate in the pre-feeding operation are controlled properly as described above, the separating roller 53 is capable of separation at a 100% efficiency irrespective of the types of paper carried in general copying machines. Thus, the condition s=1 provides the sufficiently stable sheet feeding.

Naturally, when the sheet subject to transportation is formed of a material which is unlikely to cause double feeding, the durability of the pull roller pair 55 may be given the top priority. In this case, s<1 may be a condition to be satisfied.

Figure 12:
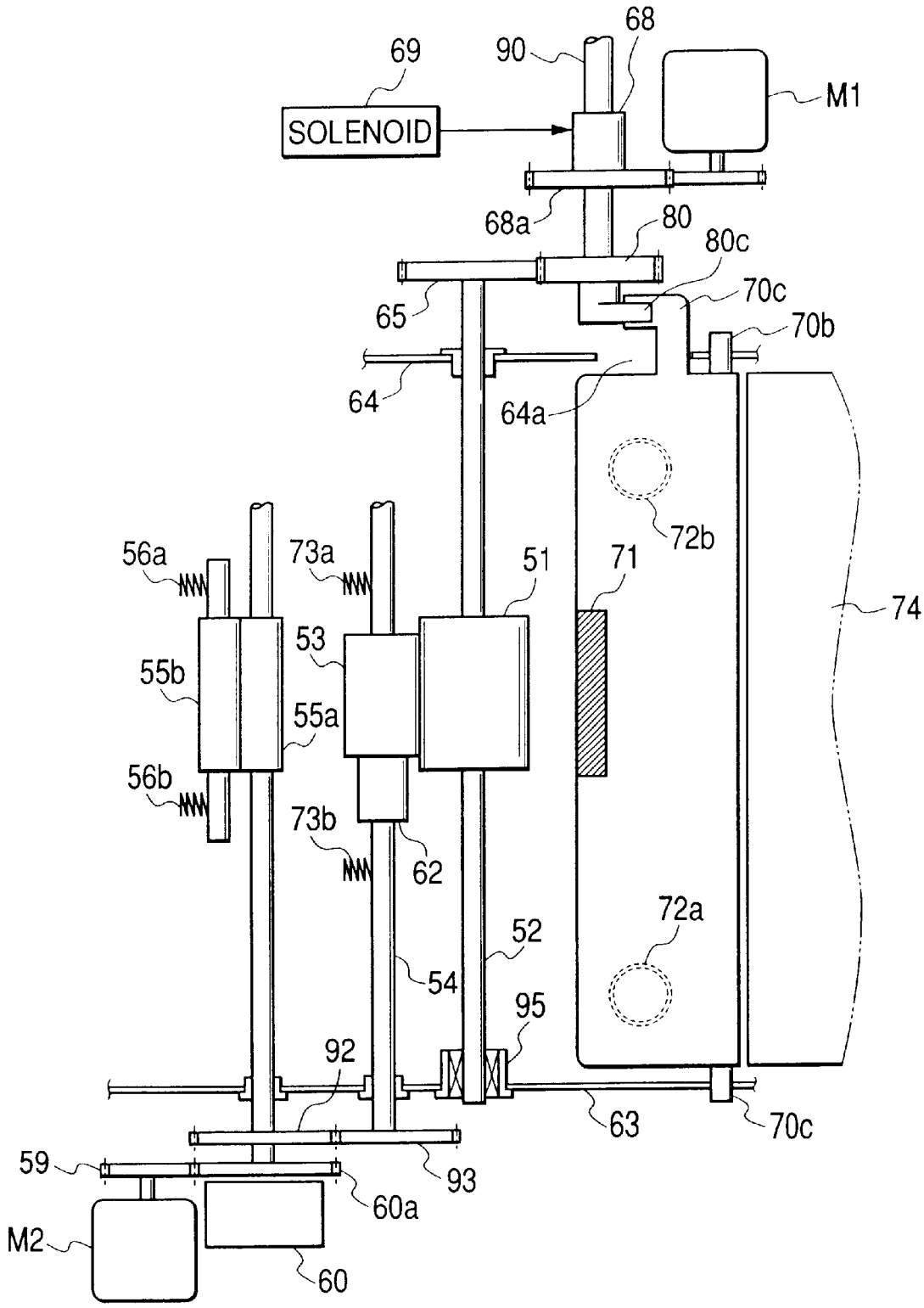
FIG. 12 is an expansion plan of a driving mechanism of the sheet feeding apparatus according to a second embodiment.
Figure 13:
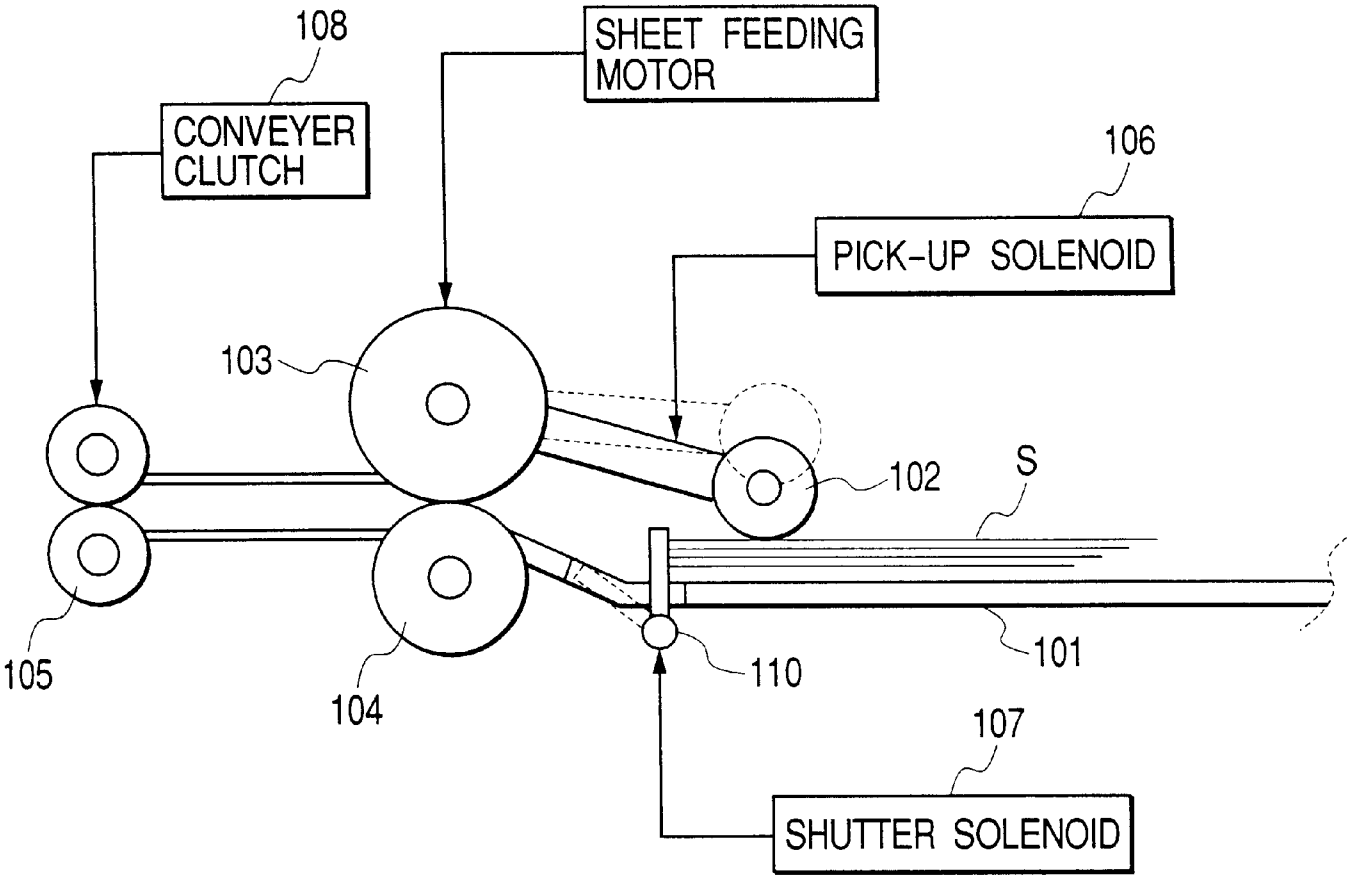
FIG. 13 is a sectional view showing an important portion of a sheet feeding unit according to the conventional art.

FIG. 12 shows an alternative embodiment of the present invention. Those constituting components that have the same construction and function as the corresponding components of the embodiment already described may be referred to by the same reference numerals and the description thereof is omitted.

In the construction according to the alternative embodiment, driving of the separating roller 53 is synchronized with the pull roller 56 via gears 92 and 93. The separating roller 53 is controlled the electromagnetic clutch (pull clutch) 60 for driving and suspension of rotation.

The separating roller 53 is driven separately from the sheet feeding roller 51. While the rotation of the sheet feeding roller 51 is suspended subsequent to the pre-feeding operation or the second sheet feeding operation, the driving force continues to be fed to the separating roller 53. With this, an improved resistance to double feeding is provided.

Since the driving of the sheet feeding roller 51 and that of the separating roller 53 are independent of each other and the sheet feeding roller shaft 52 is provided with the one-way clutch 95, the sheet feeding roller 51 is rotated as the pull roller pair 55 transports the sheet, so that the pull roller pair 55 only receives the load from the reverse force of the separating roller 53. Therefore, the durability of the pull roller pair 55 is improved.

As has been described, the rotation and suspension of rotation of the sheet feeding roller 51, the pressure and release of pressure exerted by the middle plate 70 for controlling one-time rotation against the sheet feeding roller 51 are controlled sequentially by the solenoid 69, the spring clutch 68 and the control gear 80. The resulting apparatus has a simplified construction. When the sheet is transported to a position adjacent to the pull roller pair 55, the sheet S is temporarily stopped, the middle plate 70 is removed from the sheet feeding roller 51. The transportation of the sheet is resumed after the separation is completed. Thus, sheet feeding is performed in a regular condition irrespective of the number of sheets carried.

According to the embodiment described, even after the transportation of the sheet is turned over to pull roller pair 55, the separating roller 53 continues to rotate in the reverse direction until the trailing edge of the sheet is clear of the nip between the sheet feeding roller 51 and the separating roller 53. The double-fed sheet is forced backward properly and the stable sheet feeding operation is ensured.

In the alternative embodiment described, the separating roller 53 continues to be driven in the reverse direction while the transportation by the sheet feeding roller 51 is being suspended. Therefore, similar to the embodiment as described above or more favorable advantages are available.

The pick-up operation according to the invention is performed by pressing the middle plate 70 against the sheet feeding roller 51 and releasing that pressure. The pick-up roller, required in the conventional art, is not necessary so that the sheet feeding apparatus is available at a relatively low price.

In the normal state, the middle plate 70 is removed from the sheet feeding roller 51 so that the user is not bothered while setting the bundle of sheets. In setting the sheets, the user need only apply the leading edge of the bundle of sheet against the separation guide 78. The required operation is simple and the resultant operability is excellent. Since it is extremely unlikely that the paper jam is not caused due to the user's improper operation. Accordingly, it is not necessary to provide the shutter member or the shutter control means required in the conventional art. As a result of the simplification, the apparatus of a compact size and a reduced price is provided.

The cooperation of the middle plate 70 and the sheet feeding roller 51 is controlled by the control gear 80 integrally formed of the cam 80*c* for driving the cam 70 and the two notches 80*a* and 80*b*. The pre-feeding, the second sheet feeding, the pressing and retracting of the middle plate 70 are controlled solely by the phase angles of the notches 80*a* and 80*b* and the cam 80*c*. The likelihood of fluctuation is so small that the stable sheet feeding and separating operation is performed.

The rotation and suspension of rotation of the sheet feeding roller 51 and the pressure and release thereof of the middle plate 70 are controlled only by only one on/off operation of the solenoid 69. Thus, the control according to the invention is extremely easy and the precision requirement is not severe.

By driving the sheet feeding roller and the separating roller synchronously with a connection provided by a gear series, the construction of the sheet feeding apparatus is more simplified than the apparatus according to the conventional art. In the alternative embodiment, the pull roller pair 55 and the separating roller shaft 54 are driven synchronously and the pull clutch 60 is used to drive the roller and the shaft. The resultant construction is also more simplified than the related-art apparatus.

By properly setting the relative speed of the separating roller 53 with respect to the sheet feeding roller 51, the distance of transportation by the sheet feeding roller 51 and the angle of incidence of sheet with respect to the nip line of the nip between the sheet feeding roller 51 and the separating roller 53, the sheet feeding performance is improved further and the optimum design is facilitated.

The gear parts and the cam of the control gear 80 are described as being integrally formed. However, these components may be formed to be separate from each other so that the phase angles can be adjusted.

The control gear 80 is described as being driven into a rotation by the spring clutch. However, the sheet feeding motor M1 may be driven into a rotation by a stepping motor.

The sheet feeding roller 51 and the middle plate 70 are described as being driven by the sheet feeding motor M1. The pull roller pair 55 and the separating roller 53 are described as being driven by the pull motor M2. However, these components may alternatively be driven by other means separate from a main motor driving the drum 12 and the fixer 22.

The control gear 80 is described as being provided with the two notches. However, the notch 80*b* may be eliminated. By eliminating the notch 80*b*, the sheet S is not temporarily stopped in the pre-feeding operation. The middle plate 70 is retracted before the leading edge of the sheet S reaches the pull roller pair 55. The separating operation by the separating roller is not prohibited so that the double feeding is prevented.

In this case, since the sheet S is not temporarily stopped in the pre-feeding operation, the sheet feeding can resume after a short interval. An effective means of improving the productivity is thus provided.

The present invention is described as being applied to the multi-feeding units. However, the present invention is equally applicable to cassette feeding unit and deck feeding units.

The sheet feeding apparatus of the present invention is described as being applied to the copying machine as an image forming apparatus. However, the sheet feeding apparatus may alternatively applied to the image reading apparatus by providing an image reading unit downstream from the sheet feeding apparatus of the present invention in the direction of transportation.

What is claimed is:

1. A sheet feeding apparatus, comprising:

displaceable sheet supporting means for supporting sheets;

a feeding rotation body for feeding the sheet forward by contacting the sheet supported by said displaceable sheet supporting means and rotating in a direction of transportation of the sheet;

a separating rotation body pressed against said feeding rotation body, for forcing an extra sheet other than the sheet to be fed in a reverse direction opposite to the direction of transportation so as to separate the extra sheet from the sheet to be fed;

conveying means provided downstream from said feeding rotation body and said separating rotation body in the direction of transportation, for transmitting a rotational force to rotate said feeding rotation body;

driving force transmitting means for transmitting a rotational force to rotate said feeding rotation body; and pressing and retracting means for displacing said displaceable sheet supporting means, pressed against said feeding rotation body, so as to separate said feeding rotation body from the sheet, before a leading edge of the sheet fed from said displaceable sheet supporting means reaches said conveying means due to a rotation of said feeding rotation body driven by said driving force transmitting means, wherein a condition given by $V2 \geqq (11/(L_{min}-L1)\times V1$ is satisfied, where L1 denotes a distance by which the sheet is fed by said feeding rotation body before said displaceable sheet supporting means releases its pressure, Lmin denotes a length of the sheet, subject to transportation, having a smallest length in the direction of transportation, V1 denotes a circumferential speed of said feeding rotation body, and V2 denotes a circumferential speed of the separating rotation body in the reverse direction.

2. The sheet feeding apparatus according to claim 1, wherein said driving force transmitting means suspends the rotation of said feeding rotation body before said displaceable sheet supporting means releases its pressure against said feeding rotation body and resumes driving said feeding rotation body into rotation when said displaceable sheet supporting means releases its pressure against said feeding rotation body.

3. The sheet feeding apparatus according to claim 1, wherein said driving force transmitting means comprises:

a control gear provided with notches; and a gear disposed in a position opposite to said control gear and rotated integrally with said feeding rotation body.

4. The sheet feeding apparatus according to claim 1, wherein said pressing and retracting means comprises:

a cam formed to be integral with said control gear; and a cam follower provided in said displaceable sheet supporting means so as to come into contact with said cam; and an urging spring for biasing said displaceable sheet supporting means toward said feeding rotation body, wherein said displaceable sheet supporting means is removed from said feeding rotation body against said urging spring, by causing said cam to come into contact with said cam follower, and the sheet supported by said displaceable sheet supporting means, is pressed by said urging spring against said feeding rotation body, by causing said cam to be detached from said cam follower.

5. An image forming apparatus, comprising:

displaceable sheet supporting means for supporting sheets;

a feeding rotation body for feeding the sheet forward by contacting the sheet supported by said displaceable sheet supporting means and rotating in a direction of transportation of the sheet;

a separating rotation body pressed against said feeding rotation body, for forcing an extra sheet other than the sheet to be fed in a reverse direction opposite to the direction of transportation so as to separate the extra sheet from the sheet to be fed;

conveying means provided downstream from said feeding rotation body and said separating rotation body in the direction of transportation, for transporting the sheet fed by said feeding rotation body;

driving force transmitting means for transmitting a rotational force to rotate said feeding rotation body;

pressing and retracting means for displacing said displaceable sheet supporting means, pressed against said feeding rotation body, so as to separate said feeding rotation body from the sheet, before a leading edge of the sheet fed from said displaceable sheet supporting means reaches said conveying means due to a rotation of said feeding rotation body driven by said driving force transmitting means; and image forming means for forming an image on the sheet transported by said conveying means, wherein a condition given by $V2 \geqq (L1/(L_{min}-L1)\times V1$ is satisfied, where L1 denotes a distance by which the sheet is fed by said feeding rotation body before said displaceable sheet supporting means releases its pressure, Lmin denotes a length of the sheet, subject to transportation, having a smallest length in the direction of transportation, V1 denotes a circumferential speed of said feeding rotation body, and V2 denotes a circumferential speed of the separating rotation body in the reverse direction.

* * * * *

UNITED STATES PATENT AND TRADEMARK OFFICE

CERTIFICATE OF CORRECTION

PATENT NO. : 6,609,707 B1
DATED : August 26, 2003
INVENTOR(S) : Takashi Yano

It is certified that error appears in the above-identified patent and that said Letters Patent is hereby corrected as shown below:

Title page,
Item [56], References Cited, FOREIGN PATENT DOCUMENTS, "0082746" should read -- 56-082746 --, and "0196422" should read -- 63-196422 --.

Drawings,
Sheet 10, Figure 9, "REFEEEDING" should read -- REFEEDING --.
Sheet 12, Figure 11, "PLATENT" should read -- PLATE --.

Column 2,
Line 38, "(π/π" should read -- (π/ --.

Column 5,
Line 63, "©" should read

Column 6,
Lines 65 and 67, "a" should read -- α --.

Column 7,
Line 17, "a" should read -- α --.
Line 21, "a." should read -- α. --.

Column 10,
Line 7, "camp" (both occurrences) should read -- cam --.
Line 62, "a" should read -- α --.

Column 14,
Line 56, "V2 ≦" should read -- V2 ≧ --.

Column 15,
Line 44, "the" should read -- by the --.

Column 17,
Line 64, "(11" should read -- (L1 --.

Column 18,
Line 1, "Lmin" should read -- $L_{min}$ --.

UNITED STATES PATENT AND TRADEMARK OFFICE

CERTIFICATE OF CORRECTION

PATENT NO. : 6,609,707 B1
DATED : August 26, 2003
INVENTOR(S) : Takashi Yano

It is certified that error appears in the above-identified patent and that said Letters Patent is hereby corrected as shown below:

Column 19,
Line 3, "Lmin" should read -- $L_{min}$ --.

Signed and Sealed this

Twenty-third Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,609,707 B1
DATED : August 26, 2003
INVENTOR(S) : Takashi Yano

It is certified that error appears in the above-identified patent and that said Letters Patent is hereby corrected as shown below:

Title page,
Item [56], References Cited, FOREIGN PATENT DOCUMENTS, "0082746" should read -- 56-082746 --, and "0196422" should read -- 63-196422 --.

Drawings,
Sheet No. 10, Figure 9, "REFEEEDING" should read -- REFEEDING --.
Sheet No. 12, Figure 11, "PLATENT" should read -- PLATE --.

Column 2,
Line 38, "(π/π" should read -- (π/ --.

Column 5,
Line 63, "©" should read -- @ --.

Column 6,
Lines 65 and 67, "a" should read -- α --.

Column 7,
Line 17, "a" should read -- α --.
Line 21, "a." should read -- α. --.

Column 10,
Line 7, "camp" (both occurrences) should read -- cam --.
Line 62, "a" should read -- α --.

Column 14,
Line 56, "V2 ≦" should read -- V2 ≧ --.

Column 15,
Line 44, "the" should read -- by the --.

Column 17,
Line 64, "(11" should read -- (L1 --.

Column 18,
Line 1, "Lmin" should read -- $L_{min}$ --.

UNITED STATES PATENT AND TRADEMARK OFFICE

CERTIFICATE OF CORRECTION

PATENT NO. : 6,609,707 B1
DATED : August 26, 2003
INVENTOR(S) : Takashi Yano

It is certified that error appears in the above-identified patent and that said Letters Patent is hereby corrected as shown below:

Column 19,
Line 3, "Lmin" should read -- $L_{min}$ --.

Signed and Sealed this

Twentieth Day of April, 2004

JON W. DUDAS
*Acting Director of the United States Patent and Trademark Office*